US007773933B2

(12) United States Patent
Ishino et al.

(10) Patent No.: US 7,773,933 B2
(45) Date of Patent: Aug. 10, 2010

(54) CLEANING DEVICE AND METHOD FOR AN ELECTROPHOTOGRAPHIC PHOTOCONDUCTOR

(75) Inventors: Masahito Ishino, Osaka (JP); Norio Tomiie, Osaka (JP); Katsuya Ota, Osaka (JP); Yuki Matsui, Osaka (JP); Chikara Ishihara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 239 days.

(21) Appl. No.: 11/810,635

(22) Filed: Jun. 6, 2007

(65) Prior Publication Data

US 2007/0292177 A1 Dec. 20, 2007

(30) Foreign Application Priority Data

Jun. 16, 2006 (JP) ..... 2006-167977

(51) Int. Cl.
*G03G 21/00* (2006.01)

(52) U.S. Cl. ..... 399/349; 399/350; 399/357

(58) Field of Classification Search ..... 399/349, 399/350, 357, 351, 353–355, 358–360
See application file for complete search history.

(56) References Cited

U.S. PATENT DOCUMENTS 6,292,641 B1 * 9/2001 Takeyama et al. ..... 399/228
6,816,700 B2 * 11/2004 Hatano ..... 399/349
2003/0219289 A1 * 11/2003 Kawahara et al. ..... 399/349
2006/0093955 A1 * 5/2006 Ohshima et al. ..... 430/125
2007/0020543 A1 * 1/2007 Nakatani ..... 430/108.4
2008/0056786 A1 * 3/2008 Ishino et al. ..... 399/357
2008/0069618 A1 * 3/2008 Ishino et al. ..... 399/360

FOREIGN PATENT DOCUMENTS

JP 10-063157 3/1998
JP 2005-049620 2/2005

* cited by examiner

*Primary Examiner*—David M Gray
*Assistant Examiner*—Gregory H Curran
(74) *Attorney, Agent, or Firm*—Carmody & Torrance LLP

(57) ABSTRACT

The present invention provides an image forming apparatus and an image forming method capable of preventing excessive charging in the toner within the cleaning device for effectively preventing generation of the black spots derived from the leak current. In the image forming apparatus comprising a cleaning device having a cleaning blade for scraping out the toner on a latent image carrier body surface and the image forming method using the same, the toner contains a titanium oxide as an additive agent, and with the premise that the fluorescence X ray intensity of the titanium oxide added to the toner before use is X1, and the fluorescence X ray intensity of the titanium oxide added to the toner within the cleaning device is X2, X1 and X2 satisfy the following relationship formula (1):

$$X2/X1 \geqq 1.2 \quad (1).$$

4 Claims, 10 Drawing Sheets

A

B

CLEANING DEVICE AND METHOD FOR AN ELECTROPHOTOGRAPHIC PHOTOCONDUCTOR

BACKGROUND OF THE INVENTION

1. Field of the Invention

The present invention relates to an image forming apparatus and an image forming method thereof. Specifically, it relates to an image forming apparatus capable of effectively preventing generation of black spots derived from leaked current from a cleaning device, and an image forming method using the same.

2. Description of the Related Art

Conventionally, in an electrophotographic system image forming method such as a copying machine and a printer, electrophotographic photoconductors (photoconductor drums) are widely used as a latent image carrier body. Such a common image forming method using the electrophotographic photoconductors is carried out as follows.

That is, by charging the surface of the electrophotographic photoconductor to a predetermined potential by a charging means and directing a light beam thereto from a LED light source with an exposing means, the potential at the exposed portion is attenuated by the light beam so as to form an electrostatic latent image corresponding to the original image. Then, by developing the electrostatic latent image with a developing means, a toner image is formed on the electrophotographic photoconductor surface. Finally, by contacting or setting close to the electrophotographic photoconductor and a transfer means, the toner image is transferred onto an intermediate transfer body or a paper.

On the other hand, according to the image forming method, a problem is involved in that toner not contributing to the image formation called the residual toner easily remains on the surface of the electrophotographic photoconductor after the transfer. Moreover, in the case an amorphous silicon photoconductor is used as the electrophotographic photoconductor, a problem arises in that foreign substances such as the discharge products easily adhere onto the electrophotographic photoconductor surface derived form the charging means.

Then, in order to solve such problems, a method for removing the foreign substances such as the residual toner and the discharge products on the electrophotographic photoconductor surface by adding a minute amount of a polishing agent to the toner to be used and using a polishing roller and a cleaning blade in combination has been proposed (see for example the patent documents 1 and 2).

More specifically, the patent document 1 discloses an image forming method using a toner including a polishing agent and an amorphous silicon drum as a photoconductor of developing the toner with a developing means, and polishing and cleaning the amorphous silicon drum surface with a sliding roller after the transfer, wherein an elastic layer for scavenging the polishing agent is provided on the sliding roller surface for scavenging the polishing agent in the toner by the elastic layer so as to polish and clean the drum surface with the scavenged polishing agent.

On the other hand, the patent document 2 discloses an image forming apparatus comprising a photoconductor, a sliding roller for sliding on the photoconductor surface via a toner, a scraping member for scraping off the toner on the photoconductor surface, and a toner conveying means for carrying the toner scraped off by the scraping means parallel to the roller axial direction, wherein the toner feeding rate at the intermediate portion of the sliding roller axial direction is set lower than the feeding rate at the both end portions in the sliding roller axial direction.

However, according to the image forming methods disclosed in the patent documents 1 and 2, since the characteristics of the toners are not adequately understood, the toner stored in the cleaning device can easily be charged excessively due to the friction by means of the cleaning blade and the polishing roller. That is, the phenomenon of the sudden discharge of the charge accumulated in the toner in the vicinity of the cleaning blade so as to provide the leak current flowing toward the electrophotographic photoconductor surface has been observed.

Therefore, there are problems that such leak current causes damages to the surface of the electrophotographic photoconductor, and the black spot generates on the formed image.

In particular, in the case that a method of transferring the toner supported on the surface of the latent image carrier body to the transfer body from the lower position is adopted, a phenomenon that tends to form the air gap between the toner in the vicinity of the cleaning blade and the surface of the electrophotographic photoconductor has been observed. Therefore, not only the polishing property with respect to the surface of the electrophotographic photoconductor is poor, but also the leak current generation is facilitated by means of the charge accumulated in the toner in the vicinity of the cleaning blade so as to further increase the black spot generation, and such problems still remain.

[Patent document 1] JPH10-63157A (Claims, FIG. 1)

[Patent document 2] JP2005-49620A (Claims, FIG. 1)

SUMMARY OF THE INVENTION

As a result of the elaborate discussion of the present inventors, it has been found out that formation of the air gap between the toner in the cleaning device and a latent image carrier body can be prevented by setting the ratio (X2/X1) of the fluorescence X ray intensity of a titanium oxide added to the toner before use such as carrying out a image forming method (X1) and the fluorescence X ray intensity of the titanium oxide added to the toner within the cleaning device (X2) to a predetermined range so as to complete the present invention.

That is, an object of the present invention is to provide an image forming apparatus and an image forming method capable of preventing the excessive charge in a toner in the cleaning device for effectively preventing the black spot generation derived form the leak current form the cleaning device, or the like.

According to the present invention, an image forming apparatus comprising a cleaning device having a cleaning blade for scraping out the toner on a latent image carrier body surface, wherein the toner contains a titanium oxide as an additive agent, and with the premise that the fluorescence X ray intensity of the titanium oxide added to the toner before use such as carrying out a image forming method is X1 and the fluorescence X ray intensity of the titanium oxide added to the toner within the cleaning device is X1, X1 and X2 satisfy the following relationship formula (1) is provided so as to solve the above-mentioned problems:

$$X2/X1 \geqq 1.2 \quad (1)$$

That is, since the ratio (X2/X1) of the fluorescence X ray intensity (X1) of the titanium oxide added to the toner before use such as carrying out a image forming method, and the fluorescence X ray intensity (X2) of the titanium oxide added to the toner within the cleaning device is of a predetermined value or more, the formation of the air gap between the toner in the vicinity of the cleaning blade in the cleaning device and the latent image carrier body can be prevented effectively.

Therefore, an excessive charging of the toner in the vicinity of the cleaning blade can be prevented, the generation of the leak current can be prevented, and furthermore, the generation of the black spots derived from the leak current can be prevented effectively.

In the relationship formula (1), when X1 and X2 are satisfied is at issue, and it is sufficient if the relationship formula (1) is satisfied at least either at the time of starting the drive of the image forming apparatus or during the operation.

More specifically, in a state with the power source switch of the image forming apparatus turned on, the values of X1 and X2 can be measured directly, or the substituent characteristics of the fluorescence X ray intensity can be measured for indirectly confirming that the formula is satisfied.

Moreover, at an optional point during the operation of the image forming apparatus, satisfaction of the relationship formula (1) may be confirmed by collecting the toner for directly measuring the values of X1 and X2, or measuring the substituent characteristics of the fluorescence X ray intensity for indirectly measuring the values if X1 and X2. Then the optional point during the operation of the image forming apparatus denotes the optional point after passage of 10 to 60 seconds after turning on the power source switch of the image forming apparatus or until printing 10 to 100,000 sheets of the A4 paper.

However, unless otherwise specified, as to the standard measurement point of the fluorescence X ray intensity in the present invention, satisfaction of the relationship formula (1) may be confirmed by collecting the other in the cleaning device after printing 1,000 sheets of the A4 paper for directly measuring X2 with the fluorescence X ray measurement device for the comparison with the fluorescence X ray intensity (X1) of the titanium oxide added to the toner before use such as carrying out a image forming n method.

Moreover, at the time of providing the image forming apparatus of the present invention, it is preferable that the specific resistance of the titanium oxide is set to a value within the range of $1\times10^0$ to $1\times10^2$ Ω·cm.

According to the configuration, excessive charging of the toner in the cleaning device can be prevented further effectively.

At the time of providing the image forming apparatus of the present invention, it is preferable that the additional amount of the titanium oxide is set to a value within the range of 0.1 to 5 parts by weight with respect to 100 parts by weight of the toner particle.

According to the configuration, the relationship formula (1) can be satisfied easily and furthermore, the polishing effect with respect to the electrophotographic photoconductor surface can be performed effectively.

At the time of providing the image forming apparatus of the present invention, it is preferable that silica is further contained as an additive agent of the toner, and X3 and X2 satisfy the following relationship formula (2) in the case the fluorescence X ray intensity of the silica added to the toner in the cleaning device is X3:

$$X3/X2 \leqq 20 \quad (2)$$

According to the configuration, excessive charging of the toner in the cleaning device can be prevented effectively while preferably maintaining the balance of the toner flowability and the polishing property.

At the time of providing the image forming apparatus of the present invention, it is preferable that the toner supported on the surface of the latent image carrier body is transferred onto the transfer body from the lower position.

Accordingly, in the case the toner is transferred onto the transfer body from the lower position, compared with the case of transferring the toner from the higher position, in general formation of the air gap and increase of the number of the black spots derived form the leak current are anticipated. However, in the case of the image forming apparatus of the present invention, even in the case of transferring the toner from the lower position, such generation of the number of the black spots can effectively be prevented. That is, since formation of the air gap between the toner in the vicinity of the cleaning blade and the latent image carrier body can b prevented effectively, generation of the black spots derived from the leak current can be prevented effectively.

At the time of providing the image forming apparatus of the present invention, it is preferable that the cleaning device comprising a rotatable member for cleaning the surface of the latent image carrier body (hereafter, it may be referred to as a rotatable member for cleaning or a polishing roll).

According to the configuration, the polishing effect to the surface of the latent image carrier body by the titanium oxide, or the like as an additive agent for the toner can be performed more effectively.

At the time of providing the image forming apparatus of the present invention, it is preferable that the cleaning device comprises a toner receiving member for storing the toner scraped out from the latent image carrier body.

According to the configuration, even in the case of adopting the system of transferring the toner to the transfer body from the lower position, the titanium oxide, or the like as an additive agent can be supported sufficiently on the rotatable member for cleaning, or the like.

At the time of providing the image forming apparatus of the present invention, it is preferable that the toner receiving member is a gutter-like member (drainpipe or trough) provided along the circumferential surface of the rotatable member for cleaning.

According to the configuration, not only the toner scraped out by the cleaning blade can be supported efficiently on the rotatable member for cleaning but also the toner can be carried smoothly to the toner recovering part.

At the time of providing the image forming apparatus of the present invention, it is preferable that the downstream end part with respect to the rotating direction of the rotatable member for cleaning in the toner receiving member is disposed above the contacting portion of the rotatable member for cleaning and the latent image carrier body.

According to the configuration, a state with the toner receiving member adequately filled with the toner can be maintained.

Therefore, the toner can be supported efficiently on the rotatable member for cleaning as the representative of the rotatable member for cleaning as well as the toner can be carried further smoothly to the toner recovering part.

At the time of providing the image forming apparatus of the present invention, it is preferable that a charging roller is used as the charging means for the latent image carrier body.

According to the configuration, adherence of the foreign substances such as a discharge product, which can easily be generated in the non-contact charging system, onto the surface of the electrophotographic photoconductor can be prevented.

Moreover, another aspect of the present invention is an image forming method comprising a step of scraping out a toner on a surface of a latent image carrier body by a cleaning device comprising a cleaning blade, wherein the toner contains a titanium oxide as an additive agent, and with the premise that the fluorescence X ray intensity of the titanium oxide added to the toner before use such as carrying out a image forming method is X1, and the fluorescence X ray intensity of the titanium oxide added to the toner within the cleaning device is X2, X1 and X2 satisfy the following relationship formula (1):

$$X2/X1 \geqq 1.2 \quad (1)$$

That is, according to the image forming method, generation of the leak current from the toner in the cleaning device to the surface of the electrophotographic photoconductor and generation of the black spots derived therefrom can be prevented effectively by preventing the excessive charging of the tone in the cleaning device.

Therefore, according to the image forming method, an image with a high image quality can be provided over a long period.

BEST MODE FOR CARRYING OUT THE INVENTION

The present invention provides an image forming apparatus comprising a cleaning device having a cleaning blade for scraping out the toner on a latent image carrier body surface, wherein the toner contains titanium oxide as an additive agent, and with the premise that the fluorescence X ray intensity of the titanium oxide added to the toner before use such as carrying out a image forming method is X1 and the fluorescence X ray intensity the titanium oxide added to the toner within the cleaning device is X2, X1 and X2 satisfy the following relationship formula (1)

$$X2/X1 \geqq 1.2 \quad (1)$$

Moreover, another aspect of the present invention is an image forming method comprising a step of scraping out the toner on a latent image carrier body surface by a cleaning device comprising a cleaning blade, wherein the toner contains a titanium oxide as an additive agent, and with the premise that the fluorescence X ray intensity of the titanium oxide added to the toner before use such as carrying out a image forming method is X1, and the fluorescence X ray intensity of the titanium oxide added to the toner within the cleaning device is X2, X1 and X2 satisfy the relationship formula (1).

Hereafter, the image forming apparatus and the image forming method of the present invention will be explained specifically optionally with reference to the drawings.

1. Basic Configuration of the Image Forming Apparatus

Figure 1:
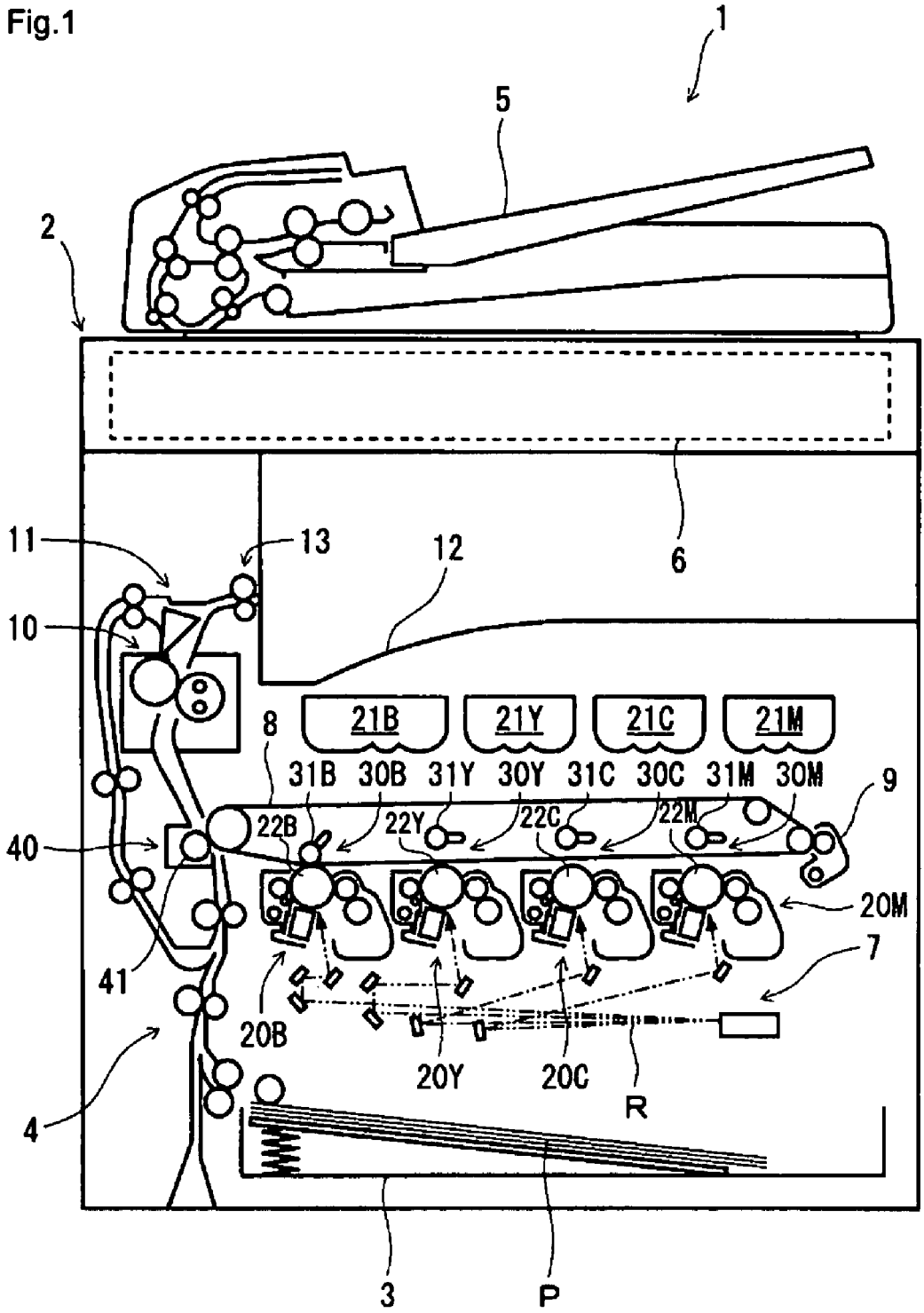
FIG. 1 is a diagram for explaining the basic structure of an image forming apparatus.

FIG. 1 is a front view in the vertical cross-section of an image forming apparatus 1. The image forming apparatus 1 is a color printing type image forming apparatus using the intermediate transfer system for transferring a toner image onto the paper. Moreover, the image forming apparatus 1 employs the system of transferring the toner supported on the surface of electrophotographic photoconductors (hereafter, they may be referred to as photoconductor drums) 22B, 22Y, 22C, 22M as the latent image carrier bodies from the lower position onto an intermediate transfer belt 8 as the transfer body (hereafter, it may be referred to as the lower transfer system).

Since the lower transfer system is used, high image quality can be maintained as well as the black image forming part to be used most frequently can be disposed closest to the secondary transfer position so that the first copying time can be reduced thereby.

On the other hand, in the case the lower transfer system is employed accordingly, compared with the case of a system of transferring the toner from the higher position, that is, the high transfer system, due to its structural reason, the phenomenon of the excessive charging of the toner in the cleaning device is caused. Therefore, black spots may easily be generated derived form the leak current from the toner in the cleaning device.

On the other hand, according to the image forming apparatus of the present invention, even in the case of using the lower transfer system, leak current from the toner in the cleaning device can be reduced so that generation of the black spots can be prevented effectively.

Therefore, in the description below, an example of the image forming apparatus using the lower transfer system of transferring the toner onto the transfer body from the lower position will be explained specifically as the image forming apparatus of the present invention.

As shown in FIG. 1, a paper cassette 3 is disposed in the lower part of a main body 2 of the image forming apparatus 1. Papers P such as cut papers before printing are piled up and stored in the paper cassette 3. Then, the papers P are to be separated and fed out one by one to the left side upward direction of the paper cassette 3. Moreover, the paper cassette 3 can be drawn out horizontally from the front surface side of the main body 2.

Moreover, a paper conveying part 4 is provided in the main body 2 to the left side of the paper cassette 3. The papers P sent out from the paper cassette 3 are carried in the vertical upward direction along the side surface of the main body 2 by the paper conveying part 4 so as to reach to a secondary transfer part 40.

On the other hand, an original sending part 5 is provided on the upper surface of the image forming apparatus 1 and an original image reading part 6 is provided therebelow. Then, in the case a user copies documents, the documents with an image such as characters, graphics, and patterns are placed on the original feeding part 5.

Then, the documents are separated one by one and fed out in the original feeding part 5 so that the image data are read out by the original image reading part 6. Then, the document data information is sent to a laser irradiation part 7 as an exposing device disposed above the paper cassette 3. Then, the laser beam R controlled based on the image data is directed toward an image forming part 20 by the laser irradiating part 7.

Moreover, total four image forming parts 20 are provided above the laser irradiation part 7 and furthermore, an intermediate transfer belt 8 using an intermediate transfer body in a form of an endless belt is provided above the image forming parts 20. The intermediate transfer belt 8 is placed around and supported by a plurality of rollers so as to be rotated in the clockwise direction in FIG. 1 by a driving device (not shown)

Moreover, the four image forming part 20 (20M, 20C, 20Y, 20B) are disposed straightly from the rotation direction upstream side of the intermediate transfer belt 8 to the downstream side. Moreover, the four image forming parts 20 refer to a magenta image forming part 20M, a cyan image forming part 20C, a yellow image forming part 20Y and a black image forming part 20B from the upstream side.

For supplying the toner to the image forming parts 20, toner supply containers 21M, 21C, 21Y, 21B corresponding to the image forming parts 20M, 20C, 20Y, 20B are provided above the intermediate transfer belt 8 so that the toner is supplied to the image forming parts 20 by a conveying means (not shown).

In the description below, unless it should be particularly limited, the identification mark showing the color of the toner "M", "C", "Y", "B" is omitted.

Then, in the image forming parts 20, an electrostatic latent image of an original image is produced by a laser beam R provided by the laser irradiation part 7 as the exposing device. Therefore, a toner image is formed corresponding to the electrostatic latent image. Moreover, a primary transfer part 30 including a primary transfer roller 31 is provided above the image forming parts 20 with the intermediate transfer belt 8 provided therebetween.

The primary transfer roller 31 is provided movably in the vertical direction in FIG. 1 so that it can be pressed against or separated from the intermediate transfer belt 8 as needed. Then, according to the movement of the primary transfer roller 31 pressed against the intermediate transfer belt 8, the intermediate transfer belt 8 is pressed against the image forming parts 20 from the higher position so that the toner images formed by the image forming parts 20 are transferred to the surface of the intermediate transfer belt 8. Then, according to the rotation of the intermediate transfer belt 8, the toner images are transferred onto the intermediate transfer belt 8 by a predetermined timing.

Therefore, a color toner images with the toner images of the four colors of magenta, cyan, yellow and black superimposed is formed on the surface of the intermediate transfer belt 8.

Moreover, a secondary transfer part 40 is disposed at a point whereat the intermediate transfer belt 8 comes in contact with the paper carrier route. The secondary transfer part 40 comprises a secondary transfer roller 41. Then, the color toner image on the surface of the intermediate transfer belt 8 is transferred onto the paper P sent synchronously by the paper conveying part 4 by the nip part formed with the intermediate transfer belt 8 and the secondary transfer roller 41 pressed against with each other. Then, the residual toner on the surface of the intermediate transfer belt 8 after the secondary transfer is cleaned by a cleaning device 9 of the intermediate transfer belt 8 provided on the upstream side of the rotation direction of the magenta image forming part 20M with respect to the intermediate transfer belt 8.

Moreover, a fixing part 10 is provided above the secondary transfer part 40. Then, the paper P with an unfixed toner image supported by the secondary transfer part 40 is sent to the fixing part 10. Therefore, the toner image is heated and pressed so as to be fixed by a fixing roller and a pressure roller.

Moreover, a branched part 11 is provided above the fixing part 10. Then, the paper P ejected from the fixing part 10 is ejected from the branched part 11 to a housed paper ejection tray 12 of the image forming apparatus 1 if the double side printing operation is not carried out.

Moreover, the ejection opening portion for ejecting the paper P from the branched part 11 to the housed paper ejection tray 12 performs the function of a switch back part 13. Then, in the case of carrying out the double side printing operation, the feeding direction of the paper P ejected form the fixing part 10 is switched at the switch back part 13. As a result, the paper P is fed downward through the branched part 11, the left side of the fixing part 10 and the left side of the secondary transfer part 40 so as to be sent to the secondary transfer part 40 again via the paper conveying part 4.

2. Image Forming Part

Then, with reference to FIG. 2, the image forming parts 20 will be explained in further detail. Moreover, since the image forming parts 20 (20M, 20C, 20Y, 20B) each using the four color toners of magenta, cyan, yellow and black mentioned above have the common structure, it will be explained without limitation of the toner color. Furthermore, as shown in FIG. 2, an example of the lower transfer system of transferring the toner from the lower position onto the intermediate transfer body 8 will be explained.

Figure 2:
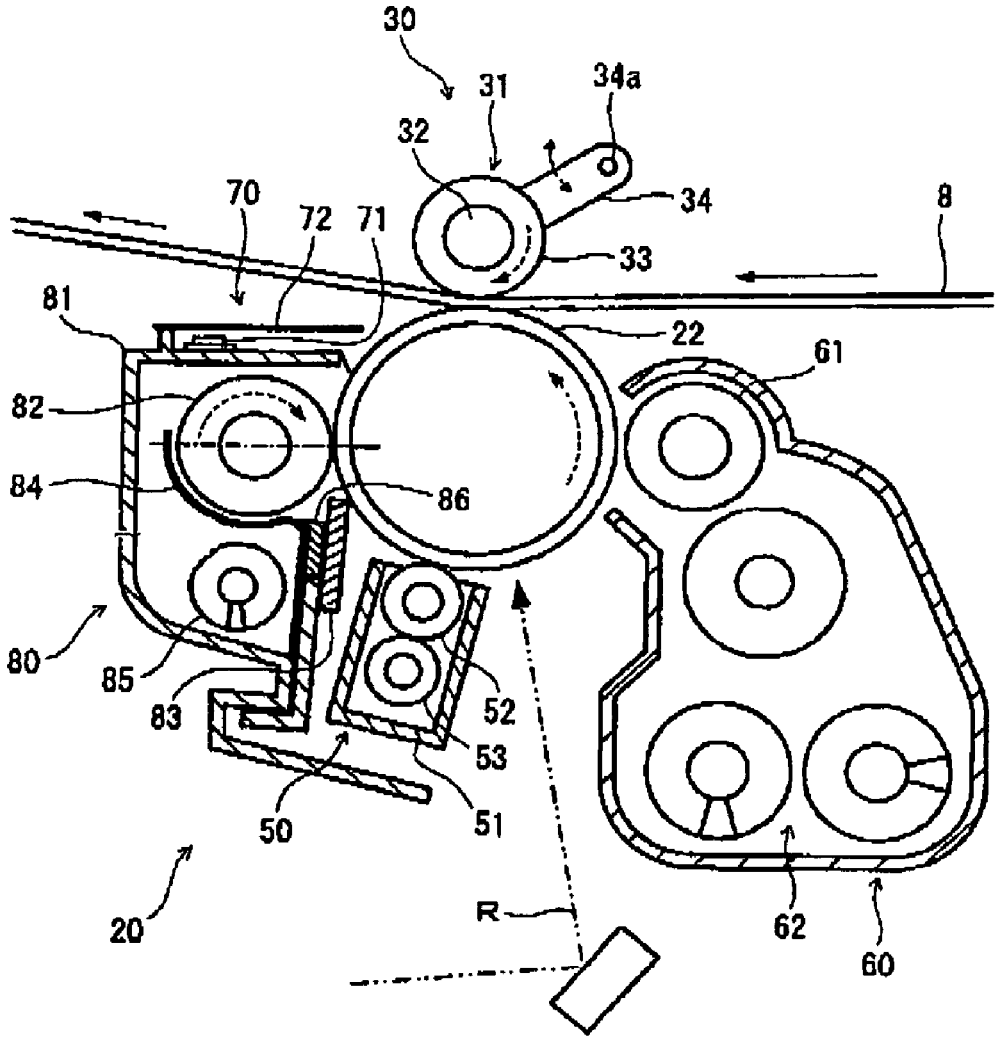
FIG. 2 is a diagram for explaining an image forming part including a developing device and a cleaning device.

Here, as shown in FIG. 2, the image forming part 20 comprises a photoconductor drum 22 as the latent image carrier body in its center. A charging device 50, a developing device 60, a charge eliminating device 70 and a cleaning device 80 are disposed successively along the rotation direction of the photoconductor drum 22 in the vicinity thereof. Moreover, the primary transfer part 30 is provided between the developing device 60 and the charge eliminating device 70 along the rotation direction of the photoconductor drum 22.

Hereafter, the image forming part 20 in the image forming apparatus 1 of the present invention will be explained specifically for the latent image carrier body (photoconductor drum), the charging device, the developing device, the charge eliminating device and the cleaning device separately.

(1) Latent Image Carrier Body

For the photoconductor drum 22 as the latent image carrier body, it is preferable to use an organic photoconductor comprising a photoreceptive layer made of a polycarbonate resin containing a charge generating agent, a charge transporting agent, or the like as the organic compound, or an inorganic photoconductor comprising a photoreceptive layer of a-Si or a-Se as the inorganic photoconductive material.

The reason thereof is that production can be facilitated with a latent image carrier body of an organic photoconductor so that it is economical. However, since the endurance of the organic photoconductor is poorer than the inorganic photoconductor, an example of the inorganic photoconductor will be presented in the description below.

That is, since the photoreceptive layer of the inorganic photoconductor has an adequate hardness, the polishing effect in the cleaning step to be described later can be performed effectively. Therefore, with an inorganic photoconductor comprising a photoreceptive layer of an a-Si based material, or the like, high quality image formation can be maintained constantly over a long period.

(1)-1 Basic configuration

Figure 3:
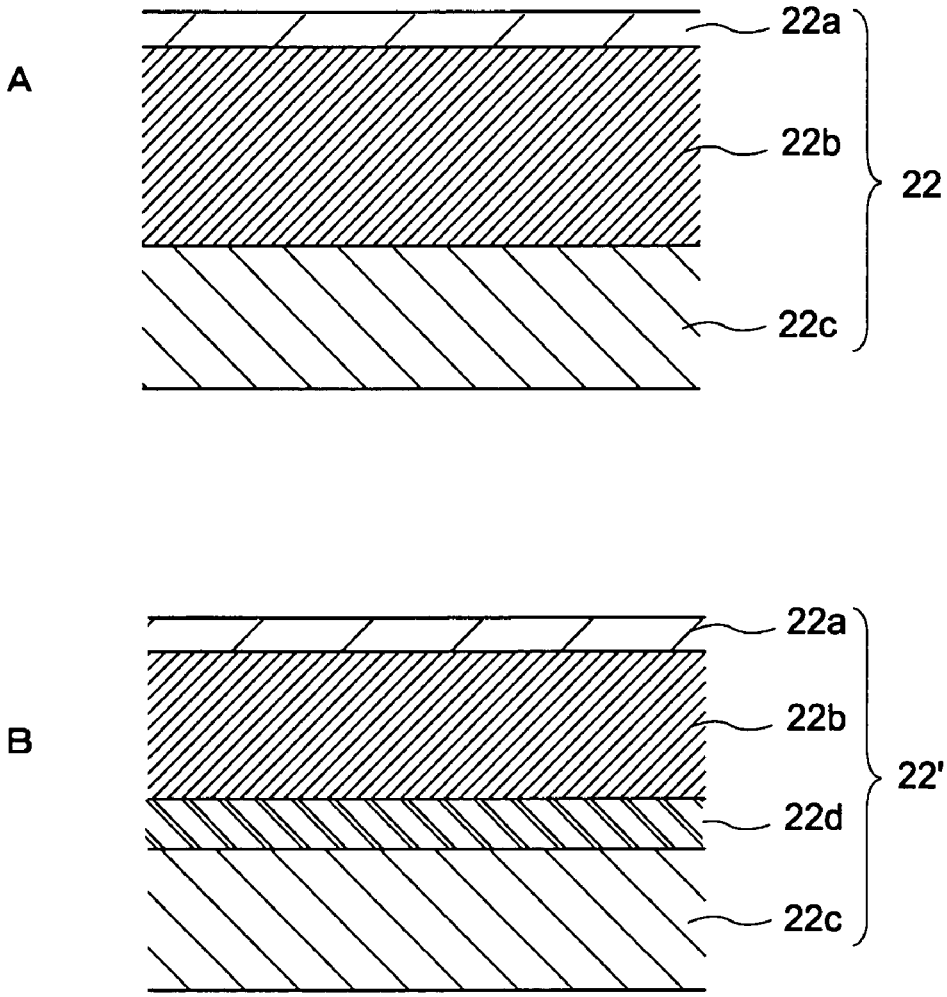
FIGS. 3A to 3B are diagrams for explaining an embodiment of the electrophotographic photoconductor.

As to the basic configuration of the photoconductor drum 22, as shown in FIG. 3A, a configuration with at least a photoconductive layer 22*b* and a surface protection layer 22*a* laminated successively on a base member 22*c* is preferable.

The reason thereof is that the surface polishing amount can be prevented by providing such a surface protection layer 22*a* and on the other hand generation of image deletion can be prevented even in the high temperature and high humidity environment so that the function of the photoconductive layer 22*b* can be performed effectively.

Moreover, as shown in FIG. 3B, a configuration with a charge injection inhibiting layer 22*d* made of an a-Si based material provided on the base member 22*c*, and the photoconductive layer 22*b* and the surface protection layer 22*a* successively laminated via the charge injection inhibiting layer 22*d* in the photoconductor drum 22' is preferable.

(1)-2 Base Member

For the base member 22*c* in the photoconductor drum 22, a conductive material including a metal material such as aluminum, stainless steel, zinc, copper, iron, titanium, nickel, chromium, tantalum, tin, gold and silver, and an alloy material thereof can be used preferably. Moreover, a base member having a conductive film of the above-mentioned metals or a transparent conductive material such as ITO and $SnO_2$ formed by deposition, or the like on the surface of an insulating material such as a resin, a glass and a ceramic can also be used.

Among these examples, an aluminum alloy is particularly preferable. The reason thereof is that in the case of using an a-Si based material as the material substance of the photoconductive layer or the charge injection inhibiting layer to be described later, not only the adhesion with these layers can be improved but also it contributes to achieving a light weight and a low cost.

(1)-3 Photoconductive Layer

Moreover, for the photoconductive layer 22*b* in the photoconductor drum 22, an a-Si based material, or an a-Se based material such as a Se—Te material and an $As_2Se_3$ material can be used preferably.

Moreover, in particular, with a material produced by adding an element such as C, O and N added to the a-Si material or the a-Si material, a photoconductor drum having the excellent photoconductive property, the high speed response property, the repetition stability, the heat resistance, the endurance, or the like and the excellent balance of the characteristics can be obtained.

The specific examples of the a-Si based materials, include such as a-Si, a-SiC, a-SiN, a-SiO, a-SiGe, a-SiCN, a-SiNO, a-SiCO, a-SiCN.

Using these a-Si based materials include such as a photoconductive layer can be formed by for example, the plasma CVD method using the glow discharge decomposition method or the ECR method, the photo CVD method, the catalyst CVD method, the reactive deposition method.

Furthermore, at the time of forming such a photoconductive layer, it is preferable to contain hydrogen or a halogen element such as fluorine and chlorine for the dangling bond end in a range of 1 to 40 atomic % with respect to the total amount.

Moreover, it is preferable that the photoconductive layer 22*b* in the photoconductor drum 22 contains a IIIa group element of the periodic table (hereafter it is abbreviated as a IIIa element) or a Va group element of the periodic table (hereafter it is abbreviated as a Va group element), or an element such as C, N and O.

The reason thereof is that the dark conductivity in the photoconductive layer, the electric characteristics such as the photoconductivity, the optical band gap, or the like can be adjusted optionally by adjusting the content of these elements.

It is preferable that the film thickness of the photoconductive layer is optionally adjusted according to the photoconductive material to be used or the desired electrophotographic characteristics, and it is preferable to set a value within the range of 5 to 100 μm, and it is more preferable to set a value within the range of 10 to 80 μm in the case of using an a-Si based material.

(1)-4 Surface Layer

For the surface layer 22*a* in the photoconductor drum 22, a-SiC, a-SiN, or the like can be used.

The reason thereof is that with these material substances, a light beam directed to the photoconductor drum can be transmitted to the photoconductive layer without excessive absorption thereof.

Moreover, since these material substances have a specific resistance in the range of $1\times10^{11}$ to $1\times10^{12}$ Ω·cm, the electrostatic latent image in the image formation can sufficiently be maintained.

Furthermore, since these material substances have a high hardness, a sufficient member endurance with respect to the friction by a cleaning rotatable member, or the like.

Hereafter, the case of using a-SiC as the material substance will be explained specifically.

First, such a surface layer made of a-SiC can be formed by mixing a Si containing gas such as $SiH_4$ (silane gas) and a C containing gas such as $CH_4$ (methane gas), and decomposing the same by the glow discharge decomposition method, or the like as in the case of the above-mentioned photoconductive layer.

The composition ratio of Si and C in the surface layer can be controlled by changing the mixing ratio of the Si containing gas and the C containing gas.

Moreover, it is preferable that a first a-SiC layer having a relatively high Si ratio with a x value within the range of 0 to 0.8 in the case a-SiC is represented by a-$Si_{1-x}C_x$:H is laminated on the photo conductive layer. It is preferable that then a second a-SiC layer having a relatively high C ratio with a x value within the range of 0.95 to 1.0 in the case a-SiC is represented by a-$Si_{1-x}C_x$:H is laminated on the first layer.

The reason thereof is that generation of the image deletion can be prevented in the high temperature and high humidity environment by making the C ratio higher on the surface side of the surface layer.

That is, since oxidation in the layer surface by ozone, or the like generated by the corona discharge can effectively be prevented by making higher the C ratio on the surface side of the surface layer, the moisture absorption property can be prevented so as not to be excessively high so that generation of the image deletion can be prevented effectively in the high temperature and high humidity environment.

Moreover, it is preferable that the film thickness of the above-mentioned first a-SiC layer is set to a value within the range of 0.1 to 2 μm.

The reason thereof is that the pressure resistance, the film strength, influence on the residual potential, or the like can be maintained in a preferable state by having the film thickness of the first a-SiC layer set to a value within such a range.

Therefore, the film thickness of the first a-SiC layer is more preferably set to a value within the range of 0.2 to 1 μm, and it is further preferable to set a value within the range of 0.3 to 0.8 μm.

Moreover, it is preferable that the film thickness of the above-mentioned second a-SiC layer is set to a value within the range of 0.01 to 2 μm.

The reason thereof is that the pressure resistance, the film strength, the wear resistance, influence on the residual potential, or the like can be maintained in a preferable state by having the film thickness of the second a-SiC layer set to a value within such a range.

Therefore, the film thickness of the second a-SiC layer is more preferably set to a value within the range of 0.02 to 1 μm, and it is further preferable to set a value within the range of 0.05 to 0.8 μm.

As to the method for forming the surface layer made of a-SiC, it can be carried out by the plasma CVD method as in the case of formation of the photo conductive layer.

(1)-5 Charge Injection Inhibiting Layer

The charge injection inhibiting layer 22*d* in the photoconductor drum 22 is a layer provided for inhibiting injection of the carrier (electron) from the base member 22*c*. As the constituent material for such a charge injection inhibiting layer, a composite material prepared by adding boron, nitrogen, oxygen, or the like as a dopant to a-Si can be used.

Moreover, it is preferable that the film thickness of such a charge injection inhibiting layer is set to a value within the range of 2 to 7 μm, and it is further preferable to set a value within the range of 3 to 6 μm.

As to the method for forming the charge injection inhibiting layer, it is preferable to employ the plasma CVD method as in the case of formation of the above-mentioned photo conductive layer and surface layer.

(2) Charging Device

Moreover, as to the kind of the charging device, although it is also preferable to use a non contact type charging means such as Scorotron, it is more preferable to use a charging roller 52 as shown in FIG. 2.

The reason thereof is that discharge products such as ozone, which can easily be generated in the non contact charging method can be prevented effectively with such a charging roller 52.

Moreover, it is preferable that the charging roller 52 has a configuration comprising a mandrel, a conductive layer provided on the outside thereof, and a resistance layer provided on the further outside thereof. Then, it is also preferable to further comprise a cleaning brush 53 to be rotated and contacted with the surface of the charging roller 52 in the housing 51 for further cleaning the surface of the charging roller 52.

For maintaining the contact force with respect to the surface of the charging roller 52 always constantly, it is more preferable to provide a pressure adjusting member between the cleaning brush 53 and the housing 51 although it is not shown (3) Developing Device Moreover, as shown in FIG. 2, it is preferable to provide a photoconductor non contact type developing roller 61 in the vicinity of the photoconductor drum 22 in the developing device 60.

In the case of such a configuration, by applying a bias of the same polarity as the charging polarity of the photoconductor drum 22 to the developing roller 61, the toner as the developing agent is charged so as to jump to the electrostatic latent image on the surface of the photoconductor drum 22 for developing the electrostatic latent image.

The developing roller 61 may be of a contact type with respect to the photoconductor drum.

Moreover, the primary transfer part 30 is provided with the primary transfer roller 31 to be contacted with the photoconductor drum 22 via the intermediate transfer belt 8. Such a primary transfer roller 31 comprises a mandrel 32 and a conductive elastic layer 33 provided on the outside thereof.

The conductive elastic layer 33 is formed with a polyurethane rubber with a conductive material such as a carbon dispersed, or the like. Moreover, the primary transfer roller 31 is supported by a frame (not shown) via an arm 34. Moreover, the arm 34 is provided rotatably around its axis part 34*a* such that the primary transfer roller 31 is moved vertically according to the rotating operation.

Therefore, the primary transfer roller 31 can be rotated according to the rotation of the intermediate transfer belt 8 by the contact with the intermediate transfer belt 8 without the need of providing a driving device.

Moreover, the primary transfer roller 31 is moved downward synchronously with the toner image formation on the surface of the photoconductor drum 22 so as to be contacted with the intermediate transfer belt 8. Thereby, the intermediate transfer belt 8 is pressed down so as to be contacted with the photoconductor drum 22. At the time, a negative transfer bias of the polarity opposite to that of the photoconductor drum 22 and the toner is applied to the primary transfer roller 31. Thereby, the toner is moved from the photoconductor drum 22 toward the primary transfer roller 31 so that the toner image is contacted and transferred onto the intermediate transfer belt 8. If the primary transfer roller 31 is moved upward, the intermediate transfer belt 8 is separated from the photoconductor drum 22.

(4) Charge Eliminating Device

Moreover, as shown in FIG. 2, the charge eliminating device 70 is disposed on the further downstream side of the primary transfer part 30 along the rotation direction of the photoconductor drum 22.

It is preferable that such a charge eliminating device 70 comprises a LED (light emitting diode) 71 and a reflection plate 72. The LED 71 is mounted on the upper surface of the housing 81 of the cleaning device 80.

Moreover, it is also preferable to use an EL (electroluminescence) light source, a fluorescent lamp, or the like instead of the LED 71. In this case, it is preferable to provide the reflection plate 72 above the LED 71 so as to cover the LED 71.

(5) Cleaning Device

Then, with reference to FIG. 4, the cleaning device 80 will be explained in further detail.

Such a cleaning device 80 disposed on the further downstream side of the primary transfer part 30 and the charge eliminating device 70 along the rotation direction of the photoconductor drum 22 comprises basically a cleaning blade 83, a cleaning rotatable member 82, a toner receiving member 84 and a housing 81.

Then, the cleaning device 80 further comprises a sweep roll 85*a*, a recovery roller 85, or the like.

(5)-1 Cleaning Blade

The cleaning device 80 comprises the cleaning blade 83. The reason thereof is that the residual toner on the surface of the photoconductor drum can be scraped out efficiently by the cleaning blade.

Moreover, according to the image forming apparatus 1 of the present invention, since the ratio of the fluorescence X ray intensity (X1) of the titanium oxide added to the toner before use, and the fluorescence X ray intensity (X2) of the titanium oxide added to the toner within the cleaning device satisfies a predetermined relationship formula, an excessive charging of the scraped residual toner stagnated in the cleaning device 80 in the vicinity of the cleaning blade 83 can be prevented. Therefore, generation of the leak current from the toner in the vicinity of the cleaning blade 83 to the photoconductor drum can effectively be prevented.

The mechanism of the leak current generation and prevent thereof will specifically be explained later in the item of the toner characteristics.

Figure 4:
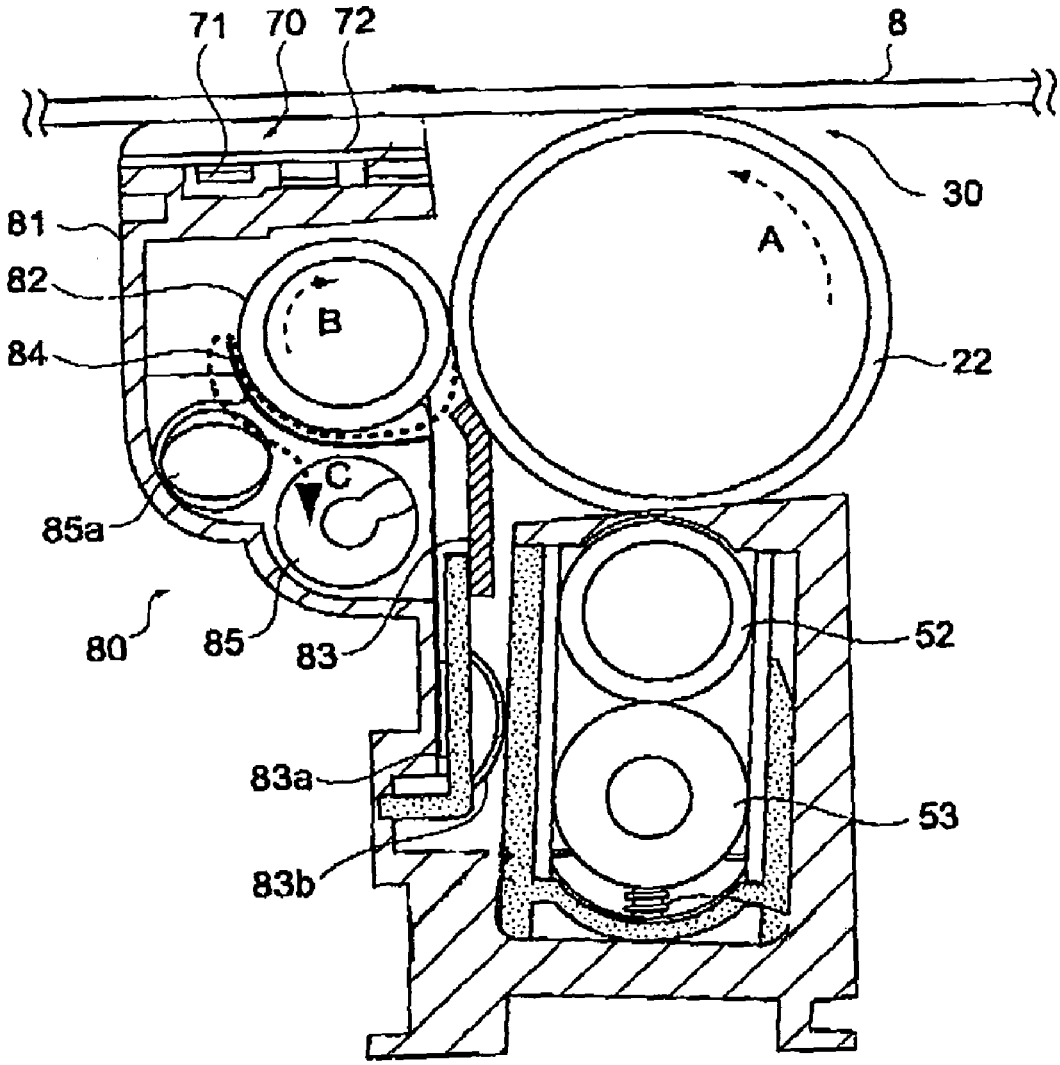
FIG. 4 is a diagram for explaining the basic structure of a cleaning device.

Moreover, as shown in FIG. 4, it is preferable that the cleaning device 83 is disposed on the downstream side of the rotation direction of the photoconductor drum 22 in the cleaning rotatable member 82 to be described later on the lower side in the vertical direction with respect to the cleaning rotatable member 82 in the housing 81. The cleaning blade 83 is provided so as to be pressured against the photoconductor drum 22 by a predetermined force by forcing means 83*a*, 83*b*.

Moreover, the cleaning blade 83 is a plate-like member made of a urethane rubber, a silicone rubber, SBR, a natural rubber, an acrylic rubber or other resin materials having the substantially same axial direction length as the photoconductor drum 22.

As to the constituent material for the cleaning blade, by further containing carbon lack, titanium oxide, or the like by a predetermined amount, the endurance can be improved or the conductivity can be provided.

(5)-2 Cleaning rotatable member

Moreover, as shown in FIG. 4, it is preferable that the cleaning device 80 comprises a cleaning rotatable member 82 for polishing the surface of the photoconductor drum 22.

The reason thereof is that the polishing effect by titanium oxide, or the like as the additive agent in the toner can be performed more effectively by providing the cleaning rotatable member 82.

On the other hand, in the case of using the cleaning rotatable member, although a problem of excessive charging of the toner in the cleaning device by friction may be raised, such charging can be prevented effectively with the image forming apparatus of the present invention.

Moreover, as shown in FIG. 4, it is preferable that the cleaning rotatable member 82 is pressed against the photoconductor drum 22 by a predetermined force by a forcing means (not shown) provided on both ends of the axial part thereof in the upper part of the housing 81.

Moreover, it is preferable that the cleaning rotatable member 82 comprises a surface layer made of an ethylene propylene rubber (EPDM), a styrene butadiene rubber (SBR), an ethylene rubber (EP), an acrylic rubber (Ac), or the like around the mandrel. In this case, it is preferable that the diameter of the cleaning rotatable member 82 is set to a value within the range of 10 to 30 mm. Then, for enlarging the effective polishing area of the cleaning rotatable member 82, it is preferable to have the substantially same axial direction length as the photoconductor drum 22.

Moreover, it is preferable that the cleaning rotatable member 82 is rotated by a driving means comprising a motor, or the like. Moreover, for efficiently polishing the surface of the photoconductor drum 22, it is preferable to rotate the cleaning rotatable member 82 by a predetermined circumferential speed.

That is, as shown by the arrow B in FIG. 4, it is preferable that the cleaning rotatable member 82 is rotated such that the surface of the contact portion with the photoconductor drum 22 is moved in the direction same as the surface of the photoconductor drum 22 (arrow A in FIG. 4). Then, it is preferable that the circumferential speed of the cleaning rotatable member 82 is set to a value within the range of 1 to 2 times as much as the circumferential speed of the photoconductor drum 22.

(5)-3 Toner Receiving Member

Figure 5:
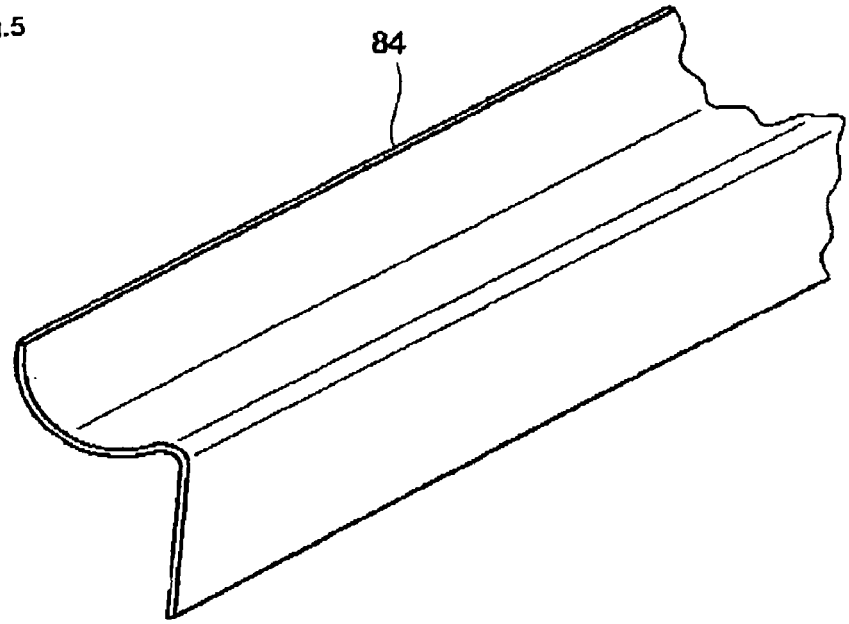
FIG. 5 is a diagram for explaining a toner receiving member.

Moreover, as shown in FIG. 4, it is preferable that the cleaning device 80 comprises a toner receiving member 84 for storing the toner scraped from the photoconductor drum 22. Then, as shown in FIG. 5, it is preferable that the toner receiving member 84 is a gutter-like member provided along the circumferential surface of the above-mentioned cleaning rotatable member 82.

The reason thereof is that titanium oxide, or the like as the additive agent can be supported sufficiently by the cleaning rotatable member 82, or the like even in the case of adopting the lower transfer system as shown in FIG. 4 by providing such a toner receiving member 84.

Moreover, with the toner receiving member 84, as shown by the arrow C in FIG. 4, the toner can be carried smoothly to the toner recovery part 85 via the sweep roll 85*a*.

That is, the toner eliminated from the surface of the photoconductor drum 22 by the cleaning rotatable member 82 and the cleaning blade 83 is to be moved (dropped) downward as it is of the cleaning rotatable member 82 or the cleaning blade 83 by the function of the gravity without the toner receiving member 84.

However, since the toner movement is blocked by the toner receiving member 84, it is stored in the gap in the vicinity of the circumferential surface of the cleaning rotatable member 82 comprising the toner receiving member 84. Then, since the toner is stored in the gap, pressure is applied to the cleaning rotatable member 82. As a result, the toner can be supported on the cleaning rotatable member 82 from the lower position in the gap.

Moreover, as to the toner not adhered to the cleaning rotatable member 82 by the function of the pressure, it can be supported on the cleaning rotatable member 82 by the function of the gravity at the downstream side end part of the rotation direction of the cleaning rotatable member 82 of the toner receiving member 84.

Then, the surface of the photoconductor drum 22 can be polished by the cleaning rotatable member 82 with the toner containing the additive agent adhered on its surface.

Moreover, as mentioned above, the additive agent can be supported efficiently on the cleaning rotatable member 82 and on the other hand, utilizing the rotation of the cleaning rotatable member 82, the toner can be carried stably in the rotation direction.

Moreover, as shown in FIG. 2, it is preferable that the downstream end part with respect to the rotation direction of the cleaning rotatable member 82 in the toner receiving part 84 is provided above the contacting portion of the cleaning rotatable member 82 and the photoconductor drum 22.

The reason thereof is that a state with the toner receiving member 84 adequately filled with the toner can be maintained with the configuration.

Therefore, the toner can be supported efficiently on the cleaning rotatable member 82 as well as the toner can be carried to the toner recovery part 85 more smoothly.

The material substance for the toner receiving member 84 include such as stainless steel (SUS), aluminum (Al), copper (Cu), silver (Ag), ceramic materials, conductive polycarbonate resins, insulating polycarbonate resins, conductive acrylic resins, insulating acrylic resins.

Moreover, it is preferable that the toner receiving member 84 has the substantially same length as the axial direction length of the cleaning rotatable member 82. Then, it is preferable that the toner receiving member 84 is provided in a form of partitioning the space with the cleaning rotatable member 82 and the cleaning blade 83 disposed and the space provided with the recovery roller 85 except the portion of the downstream side end part in the rotation direction of the cleaning rotatable member 82 in the housing 81 and storing the toner removed from the photoconductor drum 22 in the gap in the vicinity of the circumferential surface of the cleaning rotatable member 82.

Moreover, it is preferable that the gap between the toner receiving member 84 and the cleaning blade 83 is filled with a sponge (not shown). Moreover, a sealing member such as a sponge (not shown) is provided at the both end parts in the paper width direction of the toner receiving member 84 with respect to the housing 81 so that the toner stored in the toner receiving member 84 is not leaked from the portion.

(5)-4 Sweep Roller

The sweep roller 85*a* shown in FIG. 4 is a conveying member for smoothly carrying the toner eliminated from the surface of the photoconductor drum 22 by the cleaning rotatable member 82 and the cleaning blade 83 to the toner recovery part 85 as shown by the arrow C.

That is, the sweep roller 85*a* is a spherical rotatable member for homogeneous agitation of the toner without stagnation in the inside of the housing 81.

The sweep roller 85*a* may be of a resin, a metal or a ceramic, and it may also have the conventionally known configuration.

(5)-5 Recovery Roller

Moreover, as shown in FIG. 4, it is preferable that the recovery roller 85 is provided below the cleaning rotatable member 82 in the housing 81.

The reason thereof is that the waste toner in the housing 81 used for cleaning can be ejected efficiently by the recovery roller 85 to the outside of the housing 81, that is, into the waste toner recovery container.

The recovery roller 85 elongates from the inside of the housing 81 to the waste toner recovery container (not shown) provided outside the image forming part 20.

3. Toner

Moreover, as the embodiments of the toner to be used, a magnetic or non magnetic one-component toner or a two-component toner with a magnetic carrier and a non magnetic toner mixed can be used.

Moreover, although the average particle size of the magnetic toner is not particularly limited, it is preferably set to a value within the range of for example 5 to 12 μm.

The reason thereof is that the charging characteristics and the flowability characteristics of the magnetic toner are lowered, and furthermore, the isolation rate of the additive particle may be made higher if the average particle size of the magnetic value is set to a value less than 5 μm. On the other hand, if the average particle size of the magnetic toner is more than 12 μm, the toner flowability may be lowered.

Therefore, the average particle size of the magnetic toner is preferably set to a value within the range of 6 to 11 μm, and it is further preferable to set a value within the range of 7 to 10 μm.

(1) Binder Resin

Although the binder resin used for the toner particle is not particularly limited, it is preferable to use thermoplastic resins such as a styrene resin, an acrylic resin, a styrene-acrylic copolymer, a polyethylene resin, a polypropylene resin, a vinyl chloride resin, a polyester resin, a polyamide resin, a polyurethane resin, a polyvinyl alcohol resin, a vinyl ether resin, a N-vinyl resin, and a styrene-butadiene resin.

(2) Wax

Moreover, since the effects of the fixing property and the offset property are required in the toner, it is preferable to add waxes.

Not particularly limited, the kind of the waxes include such as a polyethylene wax, a polypropylene wax, a fluorine resin based wax, a Fischer Tropsch wax, a paraffin wax, an ester wax, a montan wax, a rice wax, or the like, to be used alone by one kind or as a combination of two or more kinds.

(3) Charge Control Agent

Moreover, it is preferable to add a charge control agent in the toner from the viewpoint of remarkably improving the charge level and the charge rise characteristics (index of charging to a certain charge level in a short time) for obtaining the characteristics of the excellent endurance, stability, or the like.

Although the kind of the charge control agent is not particularly limited, it is preferable to use for example a charge control agent showing the positive charging property such as a resin type charge control agent with an amine compound bonded to a nigrosine, a quaternary ammonium salt compound or a resin.

(4) Magnetic Powder and Carrier

Moreover, as a magnetic powder or a carrier, those already known can be used.

The magnetic powder or a carrier include such as a metal or an alloy showing the ferromagnetic property such as ferrite, magnetite, iron, cobalt and nickel, a compound containing these ferromagnetic elements, an alloy not containing a ferromagnetic element but capable of showing the ferromagnetic property by applying an appropriate heat treatment.

(5) Additive Agent (5)-1 Titanium Oxide

Moreover, a titanium oxide is used in the toner as the additive agent.

The reason thereof is that generation of the black spots derived form the leak current from the cleaning device can be prevented effectively by having the fluorescence X ray intensity ratio of the titanium oxide added to the toner before use and the toner within the cleaning device in a predetermined range.

The mechanism of generating the leak current, generating the black spots derived from the leak current, and preventing the same will be explained specifically later in the item of the toner characteristics.

Moreover, in particular, in the case the cleaning device comprises a cleaning rotatable member, the photoconductor drum can be polished effectively so as to maintain a preferable state even in the case of the repeated image formation by using the titanium oxide as the additive agent.

It is preferable that the average particle size of the titanium oxide is set to a value within the range of 0.01 to 0.50 μm.

The reason thereof is that if the average particle size of the titanium oxide is less than 0.01 μm, the polishing effect can hardly be performed evenly so as to generate the charge up or generate the image deletion at the time of the high temperature and high humidity so that the image defect may be caused. On the other hand, if the average particle size of the titanium oxide is more than 0.50 μm, the charging amount irregularity in the toner is made larger so that the image concentration decline and the endurance decline may be brought about.

Therefore, the average particle size of the titanium oxide is preferable to set a value within the range of 0.02 to 0.4 μm, and it is further preferable to set a value within the range of 0.05 to 0.3 μm.

The average particle size of the titanium oxide can be measured by an electron microscope and an image analysis device in combination. That is, the longer axis and the shorter axis of 50 particle were measured respectively with an electron microscope JSM-880 (produced by Nippon Denshi Datum Corp.) using optionally the magnification of 30,000 times to 100,000 times so that the average thereof were calculated with an image analysis device.

Moreover, the specific resistance of the titanium oxide is preferably set to a value within the range of $1\times10^0$ to $1\times10^2$ Ω·cm, and it is more preferable to set a value within the range of $1\times10^0$ to 5'$10^0$ Ω·cm.

The reason thereof is that the accumulated charge of the toner in the cleaning device can gradually be discharged effectively via the titanium oxide having such a low specific resistance and as a result excessive charging of the toner in the cleaning device can be prevented more effectively.

Thereby, generation of the black spots derived form the leak current can be prevented effectively by preventing generation of the leak current from the toner in the cleaning device to the photoconductor drum.

The mechanism of generating the leak current, generating the black spots derived from the leak current, and preventing the same will be explained specifically later in the item of the toner characteristics.

Here, with reference to FIG. 6, the relationship between the above-mentioned specific resistance of the titanium oxide and the number of generated black spots will be explained specifically.

Figure 6:
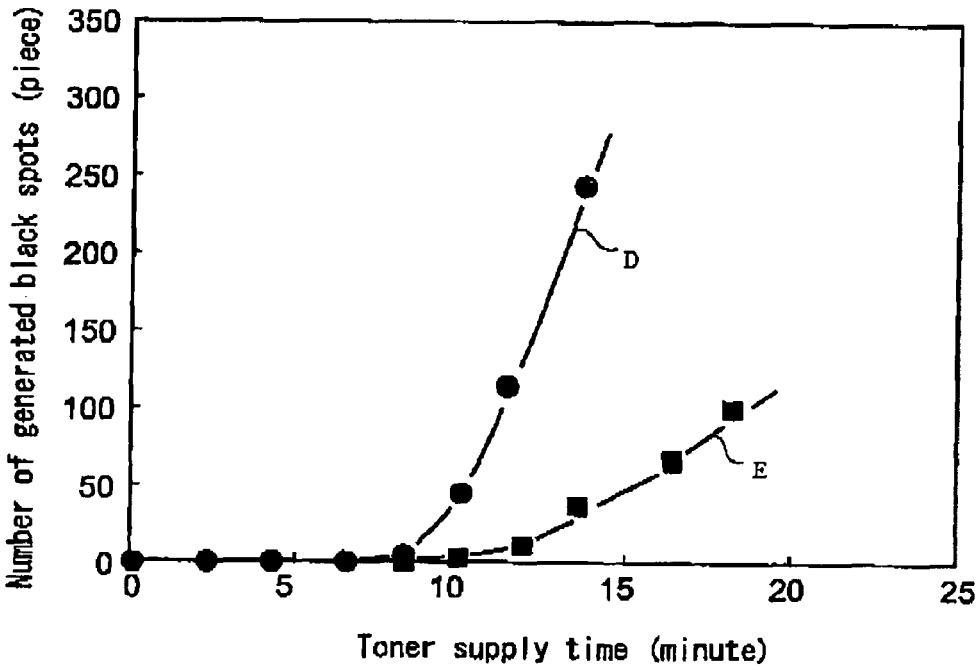
FIG. 6 is a graph for explaining the relationship between the specific resistance of titanium oxide and the number of generated black spots.

FIG. 6 shows the characteristic curves D and E with the toner supply time (minute) plotted in the lateral axis and the number of generated black spots (pieces) at the time of carrying out the acceleration test plotted in the vertical axis, respectively. As the conditions of the acceleration test, a photoconductor comprising a 15 μm film thickness a-Si photoreceptive layer was used and the primary transfer bias was in the off state. Thereby, all of the toner after development was to be recovered in the cleaning device. In the state, a printing operation was carried out by a 23 sheets/minute rate of a 6% black and white ratio (corresponding to an A4 document) without supply of A4 papers for carrying out the acceleration test.

It is confirmed that the results of the acceleration test has the correlation with, generation of the black spots in the real image forming conditions.

Here, the characteristic curve A corresponds to the case with titanium oxide of a middle specific resistance ($8\times10^2$ Ω·cm) contained as the additive agent by 1.5% by weight with respect to the total amount of the toner. Moreover, the characteristic curve B corresponds to the case with titanium oxide of a middle specific resistance ($1\times10^2$ Ω·cm) contained as the additive agent by 1.5% by weight with respect to the total amount of the toner.

Then, according to the characteristic curve A, after passing 8 minutes of the toner supply time (minute), black spot generation is started. Thereafter, the number of generated black spots (piece) continues to increase drastically. At the time of passing 15 minutes of the toner supply time (minute), the number of generated black spots (piece) has increased to about 300 pieces.

On the other hand, according to the characteristic curve B, although black spot generation is started at the time of passing about 8 minutes of the toner supply time (minute), it is not substantially increased thereafter to about 13 minutes passage of the toner supply time (minute). Then, although the number of generated black spots (pieces) is started by substantially a constant ratio at about the time of passing 13 minutes of the toner supply time (minute), the number of generated black spots (pieces) is prevented to about 120 pieces at the time of passing 20 minutes of the toner supply time (minute).

Therefore, it is learned that the number of generated black spots can be prevented effectively by providing the specific resistance of the titanium oxide as the additive agent of a value within the range of $1\times10^0$ to $1\times10^2$ Ω·cm in the acceleration test.

Moreover, since adjustment of the content of the titanium oxide added to the toner within the cleaning device can be facilitated by having the specific resistance of the titanium oxide of a value within the range of $1\times10^0$ to $1\times10^2$ Ω·cm, thereby satisfaction of the relationship formula (1) can be facilitated. As a result, excessive charging of the toner in the cleaning device can be prevented more effectively.

That is, since the charge characteristics of the titanium oxide can be changed by changing the specific resistance of the titanium oxide, the ratio of the titanium oxide to be transferred with the toner particle can be adjusted in the transfer step. As a result, adjustment of the content of the titanium oxide added to the toner to be recovered in the cleaning device can be enabled.

Here, with reference to FIGS. 7 and 8, the element analysis method using the fluorescence X ray measurement device will be explained specifically.

Figure 7:
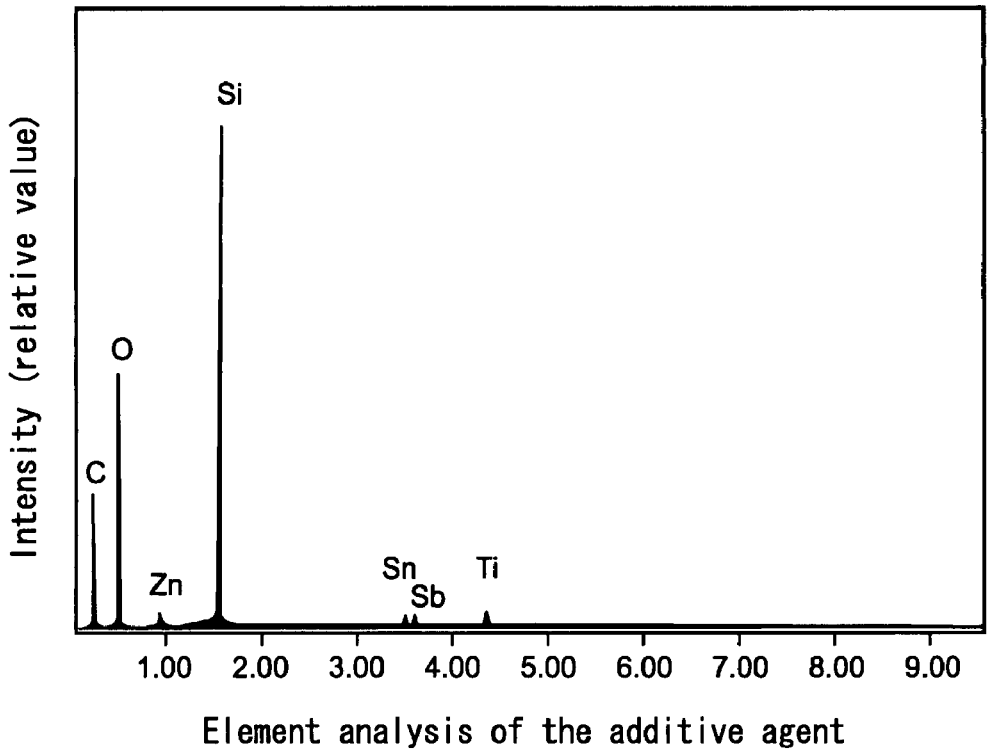
FIG. 7 is an example of a chart of the element analysis using a fluorescence X ray measurement device (No. 1)

FIG. 7 shows the results of the element analysis in the fluorescence X ray analysis device in the toner within the cleaning device in the case of using the titanium oxide of a middle specific resistance as the additive agent in the toner.

Figure 8:
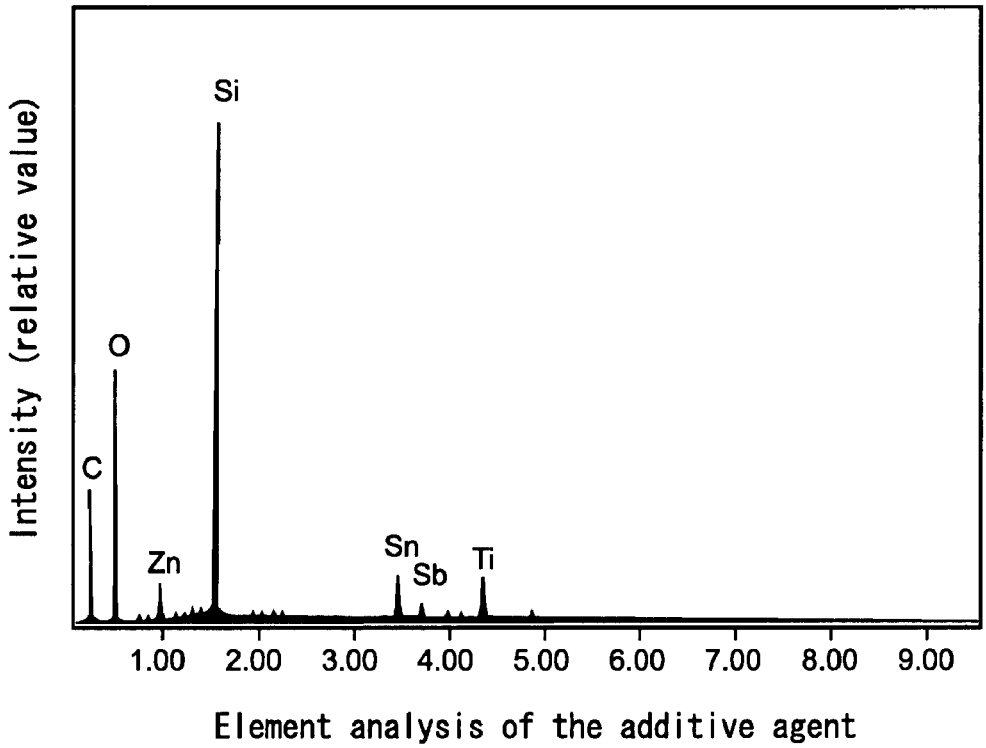
FIG. 8 is an example of a chart of the element analysis using a fluorescence X ray measurement device (No. 2)

Moreover, FIG. 8 shows the results of the element analysis in the fluorescence X ray analysis device in the toner within the cleaning device in the case of using the titanium oxide of a low specific resistance as the additive agent in the toner.

From the results of the two element analyses, it is understood that the content of the titanium oxide added to the toner within the cleaning device is more increased in the case of using the titanium oxide of the low specific resistance as the additive agent in the toner than the case of using the titanium oxide of the middle specific resistance.

Therefore, it is learned that the content of the titanium oxide added to the toner within the cleaning device can be adjusted by changing the specific resistance of the titanium oxide.

The measurement method using the fluorescence X ray analysis device will be explained in detail in the example 1, and furthermore, the content of the relationship formula (1) concerning the fluorescence X ray intensity will be explained specifically later in the item of the toner characteristics.

Moreover, it is preferable that the additional amount of the titanium oxide is set to a value within the range of 0.1 to 5 parts by weight with respect to 100 parts by weight of the toner particle.

The reason thereof is that satisfaction of the relationship formula (1) can be facilitated with the additional amount of the titanium oxide set to a value within the range of 0.1 to 5 parts by weight and on the other hand the polishing effect with respect to the photoconductor drum can be performed effectively.

That is, if the additional amount is set to a value of less than 0.1 part by weight, the titanium oxide content in the cleaning device is only minimally increased so that satisfaction of the relationship formula (1) can be difficult or the polishing effect cannot be performed effectively so that the image quality may be remarkably lowered in the high temperature and high humidity condition. On the other hand, if the additional amount is more than 5 parts by weight, the toner flowability may be deteriorated.

Therefore, the additional amount of the titanium oxide is preferably set to a value within the range of 1 to 2 parts by weight with respect to 100 parts by weight of the toner particle, and it is further preferable to set a value within the range of 1.2 to 1.6 parts by weight.

(5)-2 Silica Particle

It is preferable to have the additive agent process of the silica particle (hereafter, it may be referred to as the aggregated silica particle) as the additive agent to the toner particle.

Moreover, in the silica particle, it is preferable to have the particle size distribution with the ratio of those having a particle size of 5 μm or less of a value of 15% by weight or less, and the ratio of those having a particle size of 50 μm or more of a value of 3% by weight or less.

The reason thereof is that if the ratio of the silica particle having a particle size of 5 μm or less is more than 15% by weight, the silica particle can easily be adhered onto the photoconductor particle so as to be aggregated again, and furthermore, they are gathered around the silica particle having a relatively large particle size so as to easily cause generation of the layer irregularity. On the other hand, if the ratio of the silica particle having a particle size of 50 μm or more is more than 3% by weight, silica particle having a relatively small particle size are gathered around so as to form largely aggregated silica particle so that it can easily cause generation of the layer irregularity as well.

Therefore, as a preferable particle size distribution of the silica particle, the ratio of those having a 5 μm or less particle size is set to a value of 10% by weight or less with respect to the total amount, and the ratio of those having a 50 μm or more particle size is set to a value of 2% by weight or less.

The particle size distribution of the silica particle can be measured with a laser diffraction type particle size measurement device LA-500 produced by Horiba Ltd.

Moreover, it is preferable that the silica additional amount is set to a value within the range of 0.5 to 15.0 parts by weight with respect to 100 parts by weight of the toner particle.

The reason thereof is that the effect of improving the toner flowability may not be performed sufficiently with the additional amount of the additive agent of less than 0.5 part by weight. On the other hand, since the silica content in the toner within the cleaning device is excessively large if the additional amount of the additive agent is more than 15.0 parts by weight so that satisfaction of the relationship formula (2) may be difficult.

Therefore, the additional amount of the additive agent is preferably set to a value within the range of 0.7 to 10.0 parts by weight respect to 100 parts by weight of the toner particle, and it is further preferable to set a value within the range of 0.9 to 5.0 parts by weight. The content of the relationship formula (2) will be explained later in the item of the toner characteristics.

(6) Toner Characteristics (6)-1 Fluorescence X Ray Intensity Ratio 1

In the image forming apparatus of the present invention, with the premise that the fluorescence X ray intensity of the titanium oxide added to the toner before use is X1, and the fluorescence X ray intensity of the titanium oxide added to the toner within the cleaning device is X2, X1 and X2 satisfy the following relationship formula (1):

$$X2/X1 \geqq 1.2 \quad (1)$$

The reason thereof is that excessive charging of the toner in the cleaning device can be prevented by having the fluorescence X ray intensity ratio of the titanium oxide added to the toner before use and the toner in the cleaning device of a value within the range.

Therefore, generation of the black spots derived form the leak current can be prevented effectively by preventing generation of the leak current from the toner in the cleaning device to the photoconductor drum.

That is, if the value of X2/X1 is set to a value of less than 1.2, the titanium oxide content in the toner within the cleaning device is insufficient, and as a result, the air gap to be described later is formed so as to excessively charge the toner so that the leak current can easily be generated.

On the other hand, if the titanium oxide content in the toner within the cleaning device is excessively large, the toner flowability may be deteriorated or the charge characteristics in the photoconductor drum may remarkably be raised locally by the excessive polishing effect.

Therefore, it is more preferable that X1 and X2 mentioned above satisfy the following relationship formula (1'), and it is further preferable that they satisfy the following relationship formula (1"):

$$1.5 \leqq X2/X1 \leqq 5 \quad (1')$$

$$1.8 \leqq X2/X1 \leqq 4 \quad (1'')$$

Then, with reference to FIG. 9, the relationship between X2/X1 ratio and the number of generated black spots will be explained specifically.

Figure 9:
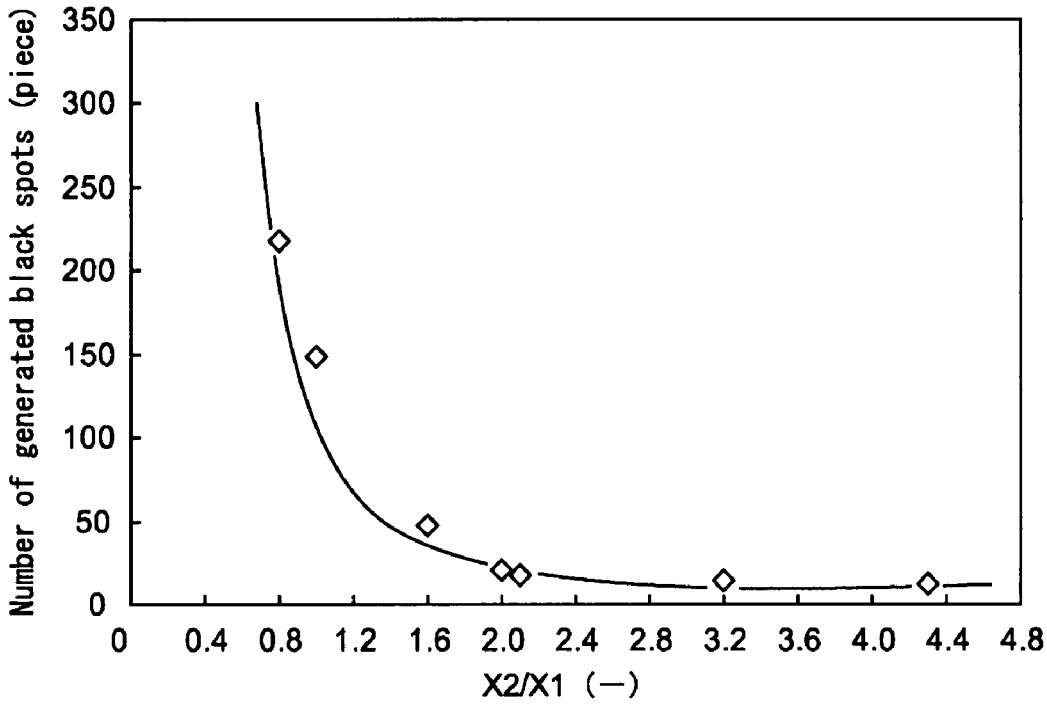
FIG. 9 is a graph for explaining the relationship between the fluorescence X ray intensity ratio (X1/X2) and the number of generated black spots.

In FIG. 9, X2/X1 ratio (–) is plotted in the lateral axis, and the number of generated black spots (pieces) in the case of carrying out the acceleration test is plotted in the vertical axis. The conditions of the acceleration test are as mentioned above.

Here, as shown by the characteristic curve in FIG. 9, it is easily understood that the number of generated black spots (piece) in the acceleration test is remarkably large with a smaller X2/X1 ratio. For example, with a 0.8 X2/X1 ratio, the number of generated black spots is more than 200 pieces.

On the other hand, the number of the black spots (pieces) in the acceleration test is reduced with a larger X2/X1 ratio. Specifically, with a 1.2 or more X2/X1 ratio, the number of generated black spots (piece) in the acceleration test is remarkably reduced.

Then, with a further larger X1/X2 ratio, the number of generated black spots (piece) in the acceleration test is further reduced, and with X2/X1 ratio of about 2 or more, the black spots are not generated substantially in the acceleration test.

Therefore, it is presumed that the number of generated black spots can effectively be prevented by having X2/X1 ratio of a predetermined value or more not only in the acceleration test but also in the real image forming apparatus.

Then, with reference to FIGS. 10A to 10C, the mechanism of generating the leak current from the toner in the cleaning device to the photoconductor drum, generating the black spots derived from the leak current, and preventing the same will be explained specifically.

Figure 10:
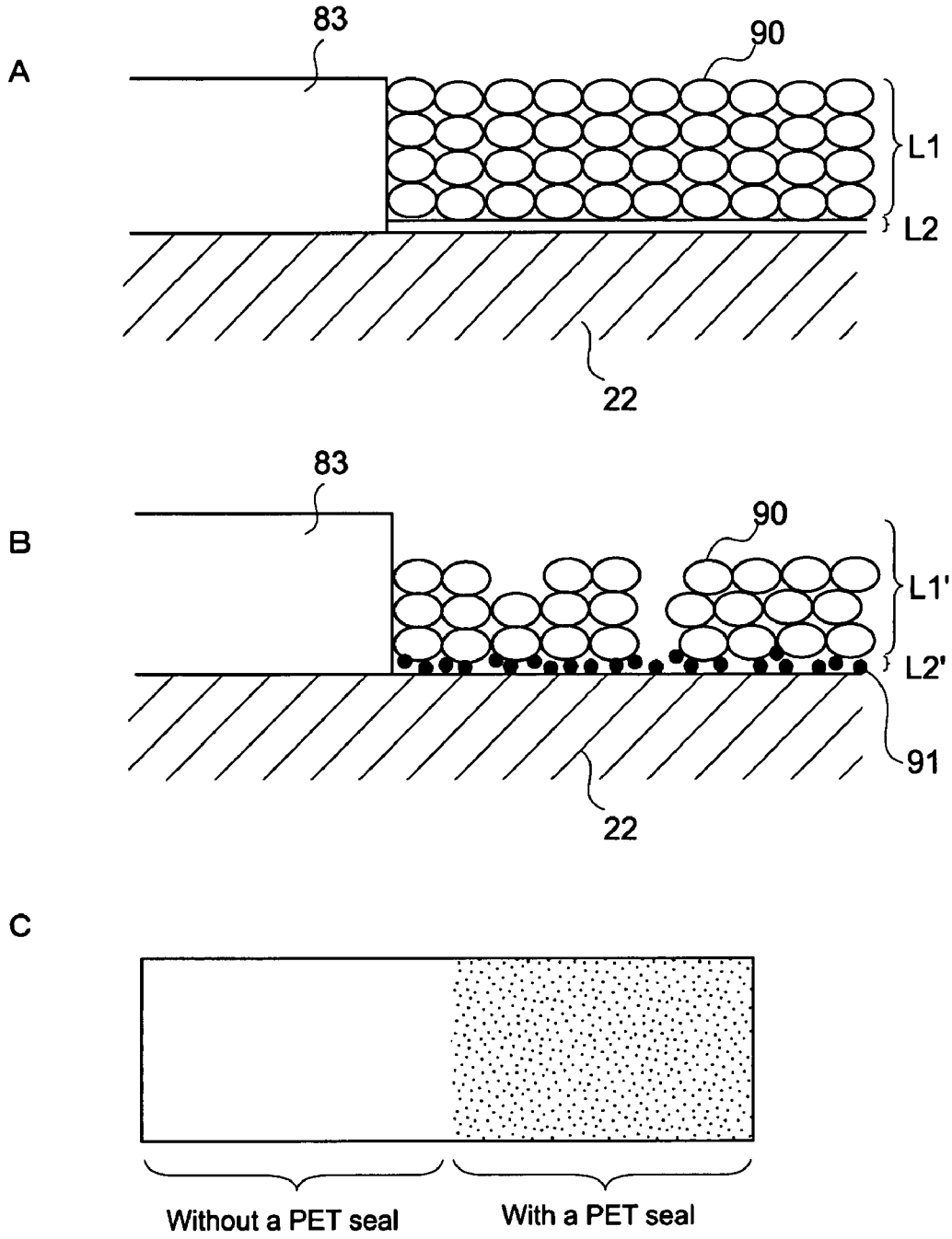
FIGS. 10A to 10C are diagrams for explaining the state of the air gap and the black spot generation.

First, as shown in FIG. 10A, since the toner 90 is supplied and the toner 90 is moved according to the rotation of the photoconductor drum and the cleaning rotatable member in the cleaning device at the time of carrying out the image formation repeatedly, friction is always generated between the toners, among the toner and the cleaning rotatable member or the cleaning blade, or the like. Therefore, at the time of carrying out the image formation repeatedly, the toner 90 in the cleaning device is naturally in a charged state.

On the other hand, the toner 90 scraped out from the electrophotographic photoconductor surface by the cleaning blade is anticipated to form an air gap (L2) of about 0.1 to 10 μm. The air gap (L2) is formed by the fact that the residual toner 90 is carried successively between the toner layer (L1) formed on the photoconductor drum, and the photoconductor drum so as to be collided with the cleaning blade and piled up for pushing the toner layer (L1) in the upward direction in FIG. 10A.

Then, the charge accumulated in the toner layer (L1) is in a state insulated by the air gap (L2) so as to lose the chance of being gradually discharged to the photoconductor drum so that the toner layer (L1) can easily be in an excessively charged state.

As a result, if the charge amount in the toner layer (L1) becomes more than a constant level, discharge (91) is formed in the air gap (L2').

Thereby, the leak current from the toner (90) in the cleaning device to the photoconductor drum is generated accordingly.

Moreover, since the photoconductor drum is damaged by the leak current, the damaged portion is observed as a black spot in the formed image.

Moreover, with reference to FIG. 10C, the relationship between the excessive charging in the toner within the cleaning device and generation of the black spots in the formed image will be explained.

That is, for experiment, a PET seal (PET: 50 μm, adhesive layer: 50 μm) was attached on the front side half portion in the depth direction of the toner receiving member 84 provided in the cleaning device 80 shown in FIG. 4. Thereby, the gap formed between the toner receiving member 84 and the cleaning rotatable member 82 disposed thereabove was completely sealed by the PET seal as to the front side half portion in the depth direction of the toner receiving member.

On the other hand, the above-mentioned gap remains as it is as to the other side half portion in the depth direction of the toner receiving member 84.

Then, a predetermined image was printed for 1,000 sheets of A4 paper using an image forming apparatus comprising the cleaning device in this state.

At the time, since the toner cannot be ejected on the side with the PET seal attached in the cleaning device, the toner is in a state of filling the portion highly densely. Furthermore, since the cleaning rotatable member 82 and the photoconductor drum 22 are rotated, the toner in the portion is in a state excessively charged by the friction.

On the other hand, since the toner is ejected along the rotation direction of the cleaning rotatable member 82 on the side without attachment of the PET seal in the cleaning device 80, excessive charging of the toner is not generated as much as on the side with the PET seal attached.

Then, FIG. 10C partially shows a blank paper image after the above-mentioned image forming process. As it is understood form FIG. 10C, black spots are generated remarkably in the image formed in the photoconductor drum portion disposed on the side with the PET seal attached (front side half portion in the depth direction).

On the other hand, black spots are not generated at all in the image formed in the photo conductor drum portion disposed on the side without the PET seal attached (deeper side half portion in the depth direction).

Therefore, from the results, it is understood that the excessive charging in the toner within the cleaning device and the generation of the black spots in the formed image are closely related.

Figure 11:
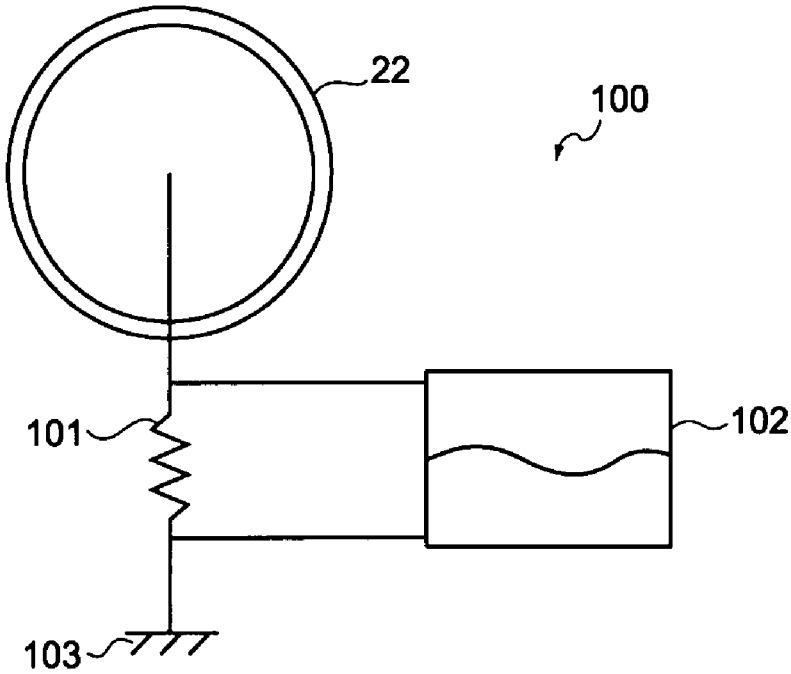
FIGS. 11A to 11B are diagrams for explaining a leak current measurement system and an example of a measurement chart.
Figure 11:
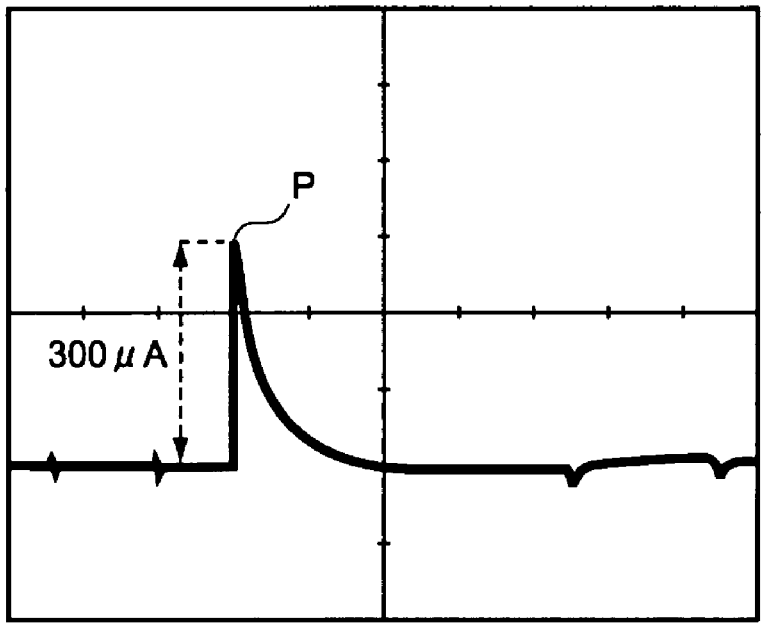

Furthermore, with reference to FIGS. 11A to 11B, the relationship between the excessive charging in the toner within the cleaning device and the leak current between the cleaning device and the photoconductor drum will be explained. That is, FIG. 1A is a diagram showing a detection system 100 for detecting the leak current between the cleaning device and the photoconductor drum, and FIG. 11B is a measurement chart of the current.

Then, at the time of measuring the leak current, the toner receiving member 84 in the cleaning device 80 shown in FIG. 4 was filled with the toner in advance and a new a-Si photoconductor drum 22 was loaded on the image forming apparatus 1.

Then, with a resistance (12 kΩ) 101 connected to the drum earth 103, the voltage change (current change) at the both ends of the resistance 100 was measured with an oscilloscope 102.

As to the other measurement conditions, the drum shaft and the motor were electrically insulated with a PET film, and the cleaning rotatable member and the toner receiving member were grounded by an earth. Moreover, the charging step, the transfer step and the developing step were omitted without execution.

As a result, as shown in FIG. 11B, it was found out that leak current having a peak (P) with the peak (P) value of about 300 μA is provided instantaneously to the photoconductor drum. Moreover, it was also confirmed that in the case such leak current is provided, the a-Si photoconductor drum surface is damaged so that black spots are generated corresponding to the portion.

Therefore, from these results, it was found out that the excessively accumulated charge in the toner within the cleaning device causes the leak current between the cleaning device and the photoconductor drum so as to lead to the surface damage of the photoconductor drum and the black spots generation.

Then, with reference to FIG. 12, the relationship among the size of the above-mentioned air gap, thee potential difference between the toner layer and the photoconductor drum, and the toner layer thickness will be explained specifically.

Figure 12:
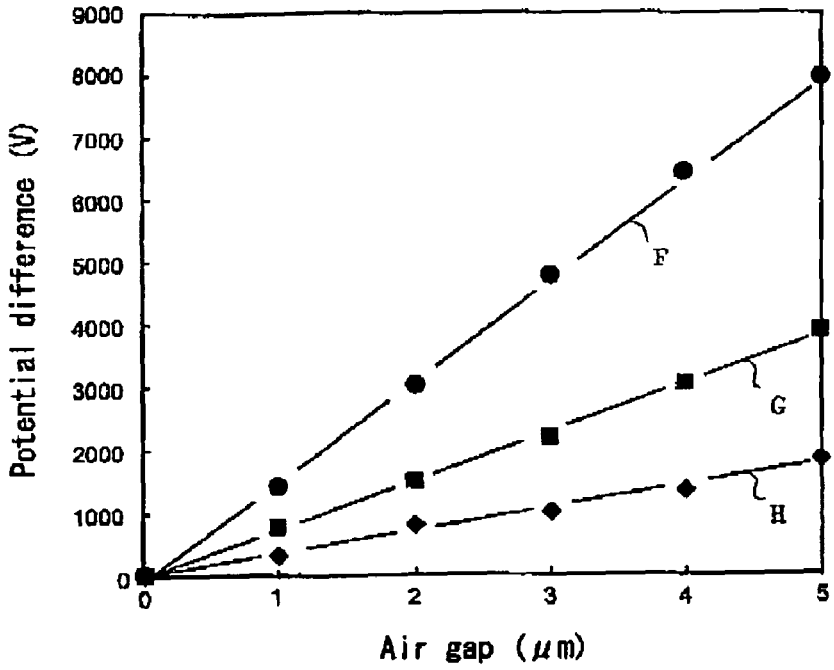
FIG. 12 is a graph for explaining the relationship between the size of the air gap and the potential difference between the toner layer and the photoconductor drum.

FIG. 12 shows the characteristic curves F to H with the air gap size (μm) plotted in the lateral axis and the potential difference (V) between the toner layer and the photoconductor drum plotted in the vertical axis. The characteristic curves A to C each correspond to the case with the toner charge amount in the toner layer of 4 μC/g and the toner layer thickness of 1 mm, 2.3 mm and 5 mm, respectively.

As it is apparent from the characteristic curves F to H, the potential difference (V) between the toner layer and the photoconductor drum, the air gap size (μm) and the toner layer thickness (mm) are substantially proportional.

Moreover, for example, in the characteristic curve G, the potential difference between the toner layer and the photoconductor drum in the case of the 3 μm air gap size is set to a value of 2,000 V or more. It shows that the potential difference between the toner layer and the photoconductor drum under the conditions that the air gap size is 3 μm and the toner layer thickness is 2.3 mm is set to a value of 2,000 V or more.

Since the air gap size and the toner layer thickness are presumed to be the average conditions, the potential difference between the toner layer and the photoconductor drum in the real image forming conditions can be set to a value of 2,000 V or more. Then, it is understood that under such conditions, discharge is generated so that an extremely large current is leaked to the photoconductor drum, and as a result the surface thereof is damaged.

On the other hand, it is confirmed from a microscope photograph that the vicinity of the cleaning blade is in a state shown in FIG. 10B with the premise that the fluorescence X ray intensity of the titanium oxide added to the toner before use is X1 and the fluorescence X ray intensity of the titanium oxide added to the toner within the cleaning device is X2, X1 and X2 satisfy the following relationship formula (1):

$$X2/X1 \geqq 1.2 \quad (1)$$

That is, it is found out that not only the toner layer (L1') thickness is relatively thin but also an opening is generated in the accumulation layer. Furthermore, it is found out that the air gap formation can be prevented effectively owing to the titanium oxide present between the toner layer (L1') and the photoconductor drum.

Therefore, since the charge accumulated in the toner layer (L1') can be discharged gradually to the photoconductor drum by adjusting the specific resistance in the titanium oxide in a preferable range, the above-mentioned photoconductor drum damage by the leak current can be prevented effectively.

Furthermore, with reference to FIG. 13, the relationship between the titanium oxide and the potential difference (V) between the toner layer and the photoconductor drum mentioned above will be explained specifically.

Figure 13:
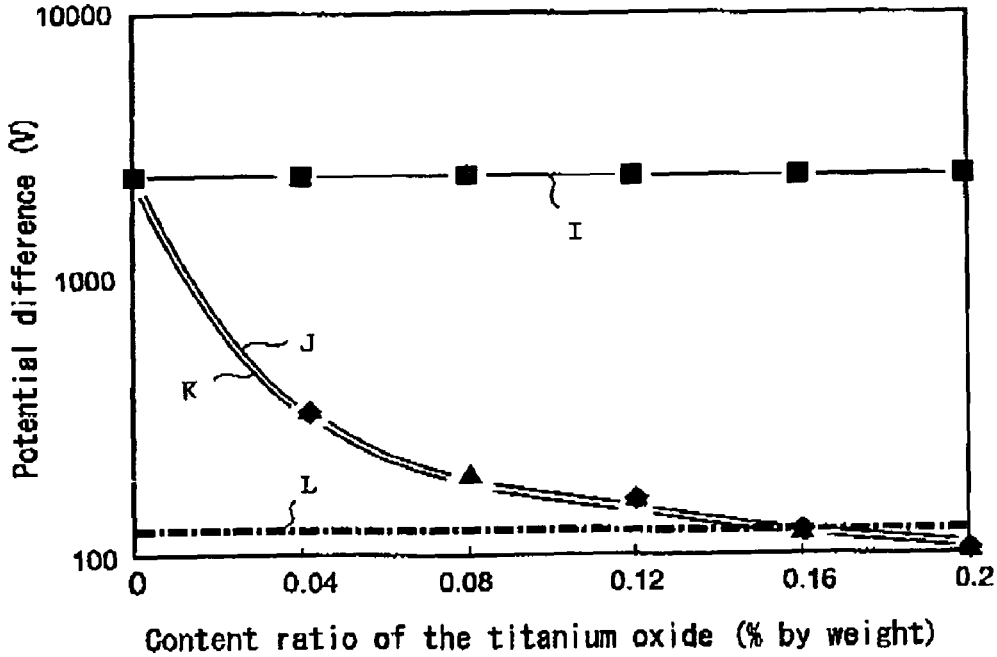
FIG. 13 is a graph for explaining the relationship between the content of an additive agent and the potential difference between the toner layer and the photoconductor drum.

FIG. 13 shows the characteristic curves I to K with the titanium oxide content ratio (% by weight) plotted in the lateral axis and the potential difference (V) between the toner layer and the photoconductor drum in the vertical axis, respectively.

The characteristic curves I to K are for the cases with the toner charge amount in the toner layer of 4 μC/g, the toner layer thickness of 2.3 mm, the air gap size of 3 μm, and the titanium oxide content ratio of the following imaginary settings: Characteristic curve I: content ratio in the case only the toner layer contains the titanium oxide (% by weight); Characteristic curve J: content ratio in the case only the air gap contains the titanium oxide (% by weight); and Characteristic curve K: the content ratio in the case both the toner layer and the air gap contain the titanium oxide (% by weight).

A characteristic curve L shows a potential difference where the spark discharge is caused between the toner layer and the photoconductor drum and, in a region above the characteristic curve L, the spark discharge is caused and thereby the black spots may be generated.

As it is learned from the characteristic curve A, in the case only the content ratio (% by weight) of the titanium oxide added to the toner layer is increased, the potential difference (V) between the toner layer and the photoconductor drum maintains about 2,000 V without substantial change.

On the other hand, as it is learned from the characteristic curve B, in the case only the content ratio (% by weight) of the titanium oxide in the air gap is increased, the potential difference (V) between the toner layer and the photoconductor drum is reduced thereby. More specifically, in the case the content ratio (% by weight) of the titanium oxide in the air gap is increased to 0.04% by weight, the potential difference (V) is reduced drastically from about 2,000 V to about 550 V. Then, in the case the content ratio (% by weight) of the titanium oxide in the air gap is further increased, the potential difference (V) continues to be reduced while slowing down the rate.

Moreover, as it is apparent from the characteristic curve C and the characteristic curve B substantially overlapped, it is understood that only the content ratio (% by weight) of the titanium oxide in the air gap influences the potential difference (V) in the case the content ratio (% by weight) of the titanium oxide are changed in both the toner layer and the air gap.

Therefore, from the characteristic curves A to C shown in FIG. 13, it is learned that the potential difference (V) between the toner layer and the photoconductor drum can be reduced by increasing the content ratio (% by weight) of the titanium oxide in the air gap.

(6)-2 Fluorescence X Ray Intensity Ratio 2

Moreover, it is preferable that silica is further contained as an additive agent of the toner in addition to the above-mentioned titanium oxide, and X2 (fluorescence X ray intensity of the titanium oxide added to the toner within the cleaning device) mentioned above and X3 satisfy the following relationship formula (2) in the case the fluorescence X ray intensity of a silica added to the toner in the cleaning device is X3:

$$X3/X2 \leqq 20 \quad (2)$$

The reason thereof is that excessive charging of the toner in the cleaning device can be prevented effectively while preferably maintaining the balance between the toner flowability and the polishing property as a result of the improvement of the toner flowability by use of the silica as an additive agent.

That is, if the (X3/X2) value is more than 20, contact among the titanium oxide particle in the air gap is inhibited by the silica of the excessive amount so that efficient gradual discharge of the charge accumulated in the toner to the photoconductor drum may be difficult.

On the other hand, if the silica content in the toner within the cleaning device is excessively small, the toner flowability improvement may be difficult.

Therefore, it is more preferable that X2 and X3 mentioned above satisfy the following relationship formula (2'), and it is further preferable that they satisfy the following relationship formula (2"):

$$3 \leqq X3/X2 \leqq 15 \quad (2')$$

$$5 \leqq X3/X2 \leqq 10 \quad (2'')$$

EXAMPLES

Hereafter, the present invention will be explained in further detail with reference to the examples. Naturally, the description hereafter exemplifies the present invention so that the scope of the present invention is not limited by the following description without any specific reason.

Example 1

1. Production of the Toner (1) Production of the Toner Particle

First, as the binder resin, a plurality of polyester resins were used and the magnetic powders, or the like were mixed therewith, melted and kneaded.

That is, 100 parts by weight of a polyester resin (alcohol component: bisphenol A propion oxide adduct, acid component: terephthalic acid, Tg: 60° C., softening point: 150° C., acid value: 7.0, gel percentage: 30%), 3 parts by weight of CCA (product name: BONTRON No. 1, produced by Orient Chemical Industries, Ltd.) as the charge control component, 3 parts by weight of a charge control resin (quaternary ammonium salt added styrene-acrylic copolymer; FCA196 produced by FUJIKURA KASEI CO., LTD.), and 3 parts by weight of ester wax (product name: WEP•5, produced by Nippon Yushi Corp.) as the wax component were mixed with a Henschel mixer.

Then, after further kneading with a two-axial extruder (cylinder setting temperature: 100° C.), it was coarsely pulverized with a feather mill. Thereafter, it was finely pulverized with a turbo mill and classified with an airflow type pulverizer so as to obtain toner particle with a 8.0 μm average particle size.

(2) Addition of the Additive Agent

A toner was obtained by mixing 0.8 part by weight of silica particle (product name: RA200HS produced by NIPPON AEROSIL CO., LTD.) and 1.0 part by weight of titanium oxide (product name: EC300, produced by TITAN KOGYO KK) with 100 parts of the obtained toner particle. The specific resistance of the titanium oxide was 30 Ω·cm.

2. Fluorescence X Ray Measurement (1) Fluorescence X Ray Intensity of the Titanium Oxide Added to the Toner Before Use The fluorescence X ray intensity (X1) of the titanium oxide in the obtained toner was measured with a fluorescence X ray measurement device.

That is, after obtaining disc like pellets (diameter 40 mm, thickness 5 mm) by applying a 20 MPa pressure for 3 seconds to 5 g of the toner particle with a specimen press shaping machine (BRE-32: produced by MAEKAWA TESTING MACHINE CORP.), the fluorescence X ray peak intensity (kcps) of Ti, or the like contained in the toner was measured with a fluorescence X ray measurement device RIX200 produced by RIGAKU CORP. (voltage: 50 kV, current: 30 mA, X ray bulb: Rh).

(2) Fluorescence X Ray Intensity of the Titanium Oxide Added to the Toner Within the Cleaning Device Moreover, the fluorescence X ray intensity (X2) of the titanium oxide added to the toner within the cleaning device was measured with a fluorescence X ray measurement device.

That is, after forming a predetermined image for 1,000 sheets of A4 paper with the obtained toner and KM-C3232 produced by Kyoceramita Corp. under the following conditions, the toner was taken out from the cleaning device of the image forming apparatus. In the same manner as in the above-mentioned fluorescence X ray intensity measurement for the toner before use except that the toner after use was used, measurement was carried out with the fluorescence X ray measurement device.

The image forming conditions, or the like at the time of measuring the fluorescence X ray intensity were as follows.

(Image Forming Conditions)
Environment: 23° C.50% RH
Document: 6% document with respect to each color Photoconductor: amorphous silicon photoconductor (film thickness 15 μm)
Drum circumferential speed: 150 mm/s
Printing speed: 32 sheets/minute
Surface potential: 270 V (Charging Conditions)
AC bias: 1.2 kVpp
DC bias: 350 V (Cleaning Blade Conditions)
Blade hardness: 70° (JIS-A standard)
Material: urethane
Thickness: 2.2 mm
Projecting length: 11 mm
Linear pressure: 22 g/cm
Contact angle: 25°

(Slide Friction Roller)
Outer diameter: 15 mm
Thickness: 1.5 mm
Material: EPDM
Circumferential speed difference with respect to the drum: 1.2 times (rotated in the trail direction with respect to the drum)
Asker C hardness: 35°

(3) Fluorescence X Ray Intensity of the Silica Added to the Toner Within the Cleaning Device Moreover, the fluorescence X ray intensity (X3) of the silica added to the toner within the cleaning device was measured with a fluorescence X ray measurement device.

That is, in the same manner as in the fluorescence X ray intensity measurement of the titanium oxide added to the toner within the cleaning device mentioned above, it was measured with the fluorescence X ray measurement device.

(4) Fluorescence X Ray Intensity Ratio

Moreover, from the obtained X1 to X3, the values of (X2/X1) and (X3/X2) as the fluorescence X ray intensity ratio were calculated respectively. The obtained results are shown in the table 1.

3. Evaluation (1) Evaluation of the Number of Generated Black Spots

The number of generated black spots was evaluated after image formation with the obtained image forming apparatus.

That is, after forming a predetermined image continuously for 1,000 sheets of A4 paper under the above-mentioned conditions, a blank paper image (A4 paper) was formed for counting the number of generated black spots in the blank image for evaluation according to the following criteria. The obtained results are shown in the table 1.

Very Good: The number of generated black spots is set to a value of less than 20 pieces/A4 paper.
Good: The number of generated black spots is set to a value from 20 to less than 50 pieces/A4 paper.
Fair: The number of generated black spots is set to a value from 50 to less than 100 pieces/A4 paper.
Bad: The number of generated black spots is set to a value of more than 100 pieces/A4 paper.

Example 2

Moreover, in the example 2, a toner was produced and evaluated in the same manner as in the example 1 except that the content of the titanium oxide as the additive agent was changed to 0.8 part by weight with respect to 100 parts by weight of the toner particle at the time of producing the toner. The obtained results are shown in the table 1.

Example 3

Moreover, in the example 3, a toner was produced and evaluated in the same manner as in the example 1 except that the content of the silica as the additive agent was changed to 1.5 parts by weight with respect to 100 parts by weight of the toner particle at the time of producing the toner. The obtained results are shown in the table 1.

Example 4

Moreover, in the example 4, a toner was produced and evaluated in the same manner as in the example 1 except that titanium oxide having a 10 Ω·cm specific resistance (product name: EC100, TITAN KOGYO KK) was used as the additive agent at the time of producing the toner. The obtained results are shown in the table 1.

Example 5

Moreover, in the example 5, a toner was produced and evaluated in the same manner as in the example 4 except that the content of the titanium oxide as the additive agent was changed to 1.2 parts by weight with respect to 100 parts by weight of the toner particle at the time of producing the toner. The obtained results are shown in the table 1.

Comparative Example 1

Moreover, in the comparative example 1, a toner was produced and evaluated in the same manner as in the example 1 except that titanium oxide having a 120 Ω·cm specific resistance (produced by adjusting the amounts of Sb and $SnO_2$ to be added to the original of EC100) was used as the additive agent at the time of producing the toner. The obtained results are shown in the table 1.

Comparative Example 2

Moreover, in the comparative example 2, a toner was produced and evaluated in the same manner as in the comparative example 1 except that the content of the titanium oxide as the additive agent was changed to 0.8 part by weight with respect to 100 parts by weight of the toner particle at the time of producing the toner. The obtained results are shown in the table 1.

TABLE 1

| | Titanium oxide | | | Fluorescence | | Evaluation of the number of generated black spots | |
|---|---|---|---|---|---|---|---|
| | Content (part by weight) | Specific resistance (Ω · cm) | Silica content (part by weight) | X ray intensity ratio X2/X1 | X ray intensity ratio X3/X2 | Number of generated black spots (piece/A4 paper) | Evaluation |
| Example 1 | 1.0 | 30.0 | 0.8 | 2.1 | 9.2 | 18 | Very good |
| Example 2 | 0.8 | 30.0 | 0.8 | 2.0 | 9.8 | 21 | Good |
| Example 3 | 1.0 | 30.0 | 1.5 | 1.6 | 15.1 | 48 | Good |
| Example 4 | 1.0 | 10.0 | 0.8 | 3.2 | 8.5 | 14 | Very good |
| Example 5 | 1.2 | 10.0 | 0.8 | 4.3 | 7.9 | 12 | Very good |
| Comparative example 1 | 1.0 | 120.0 | 0.8 | 1.0 | 18.0 | 149 | Bad |
| Comparative example 2 | 0.8 | 120.0 | 0.8 | 0.8 | 23.4 | 218 | Bad |

According to the image forming apparatus of the present invention and the image forming method using the same, excessive charging in the toner within the cleaning device can be prevented by setting the fluorescence X ray intensity ratio of the titanium oxide added to the toner before use and the toner within the cleaning device to the predetermined range. As a result, generation of the black spots derived from the leak current from the cleaning device can be prevented effectively.

Therefore, the image forming apparatus of the present invention and the image forming method using the same are expected to remarkably contribute to improvements of the image characteristics in various kinds of the image forming apparatus such as a copying machine and a printer.

What is claimed is:

1. An image forming apparatus, which includes a latent image carrier and comprises a charging device, a developing device, a primary transferring part for transferring the toner to an intermediate transfer body, a charge eliminating device, and a cleaning device comprising a rotatable member and a toner receiving member for preventing excess charge in a toner, which are arranged in sequence around the latent image carrier, wherein:

the latent image carrier is located below the intermediate transfer body, for transferring the toner carried on a surface thereof from downward to the intermediate transfer body, the cleaning device having the rotatable member for cleaning the surface of the latent image carrier, a cleaning blade which is located below the rotatable member for scraping out a toner on the latent image carrier body surface and the toner receiving member for storing the toner scraped out from the latent image carrier body, the toner receiving member is a gutter member provided along the circumferential surface of the rotatable member for cleaning, which is storing the scraped toner in the gap in the vicinity of the circumferential surface of the cleaning rotatable member and carrying to a toner recovery part, wherein the toner contains an additive agent comprising a titanium oxide, the specific resistance of the titanium oxide is a value in a range of $1\times10^0$ to $1\times10^2$ Ω·cm, and the addition amount of the titanium oxide is a value in a range of 0.1 to 5 parts by weight with respect to 100 parts by weight of the toner particles, wherein the fluorescence X ray intensity of the titanium oxide added to the toner before use is X1, and the fluorescence X ray intensity of the titanium oxide added to the toner within the cleaning device is X2, and X1 and X2 satisfy the following relationship formula (1):

$$X2/X1 \geqq 1.2 \quad (1)$$

and wherein the additive agent further comprises a silica, and wherein the addition amount of the silica is a value in a range of 0.5 to 15.0 parts by weight with respect to 100 parts by weight of the toner particles, and the fluorescence X ray intensity of the silica added to the toner within the cleaning device is X3 and X3 and X2 satisfy the following relationship formula (2):

$$X3/X2 \leqq 20 \quad (2).$$

2. The image forming apparatus according to claim 1, wherein the toner receiving member extends along a portion of the rotatable member and an end of the toner receiving member on a side of the rotatable member opposite from a contacting point of the rotatable member and the end of the toner receiving member is higher than the contacting point.

3. The image forming apparatus according to claim 1, wherein a charging roller is used as a charging means for the latent image carrier body.

4. An image forming method used with an image forming apparatus which includes a latent image carrier and comprises a charging device, a developing device, a primary transferring part for transferring the toner to an intermediate transfer body, a charge eliminating device, and a cleaning device comprising a rotatable member and a toner receiving member for preventing excess charge in a toner which are arranged in sequence around the latent image carrier, wherein the latent image carrier which is located under the intermediate transfer body, for transferring the toner carried on a surface thereof from downward to an intermediate transfer body, the method comprising the steps of:

cleaning the surface of the latent image carrier body by the cleaning device having the rotatable member;

scraping out a toner on the latent image carrier body surface by the cleaning device having a cleaning blade which is located below the rotatable member, and storing the scraped toner from the latent image carrier body in the gap in the vicinity of the circumferential surface of the cleaning rotatable member and carrying to a toner recovery part by the cleaning device having the toner receiving member which is a gutter member provided along the circumferential surface of the rotatable member for cleaning, wherein the toner contains an additive agent comprising a titanium oxide, the specific resistance of the titanium oxide is a value in a range of $1\times10^0$ to $1\times10^2$ Ω·cm, and the addition amount of the titanium oxide is a value in a range of 0.1 to 5 parts by weight with respect to 100 parts by weight of the toner particles, wherein the fluorescence X ray intensity of the titanium oxide added to the toner before use is X1, and the fluorescence X ray intensity of the titanium oxide added to the toner within the cleaning device is X2, and X1 and X2 satisfy the following relationship formula (1):

$$X2/X1 \geqq 1.2 \quad (1)$$

and wherein the additive agent further comprises a silica, and wherein the addition amount of the silica is a value in a range of 0.5 to 15.0 parts by weight with respect to 100 parts by weight of the toner particles, and the fluorescence X ray intensity of the silica added to the toner within the cleaning device is X3 and X3 and X2 satisfy the following relationship formula (2):

$$X3/X2 \leqq 20 \quad (2).$$

* * * * *